US010751236B2

(12) United States Patent
Kaufman et al.

(10) Patent No.: US 10,751,236 B2
(45) Date of Patent: Aug. 25, 2020

(54) PORTABLE FRAME

(71) Applicant: Thought Forward Design LLC, New York, NY (US)

(72) Inventors: Henry R. Kaufman, New York, NY (US); Meryl L. Unger, New York, NY (US)

(73) Assignee: Thought Forward Design LLC, New York, NY (US)

( * ) Notice: Subject to any disclaimer, the term of this patent is extended or adjusted under 35 U.S.C. 154(b) by 0 days.

(21) Appl. No.: 16/531,779

(22) Filed: Aug. 5, 2019

(65) Prior Publication Data

US 2020/0054511 A1 Feb. 20, 2020

Related U.S. Application Data

(63) Continuation of application No. 15/813,769, filed on Nov. 15, 2017, now abandoned.
(Continued)

(51) Int. Cl.
*A61G 7/10* (2006.01)
*A47C 7/54* (2006.01)
(Continued)

(52) U.S. Cl.
CPC ..... *A61G 7/1038* (2013.01); *A47C 7/541* (2018.08); *A47C 7/546* (2013.01); *A47C 16/00* (2013.01); *A47C 20/023* (2013.01)

(58) Field of Classification Search
CPC ..... A61H 2003/006; A61H 3/0244; A61G 7/1038; A47C 7/541; A47C 16/00; A47C 20/023
See application file for complete search history.

(56) References Cited

U.S. PATENT DOCUMENTS 2,607,926 A * 8/1952 De Puy ..... A47C 12/02 4/254
2,627,904 A 2/1953 Thieman
(Continued)

FOREIGN PATENT DOCUMENTS

FR 2 857 856 A1 1/2005
FR 2 865-932 A1 8/2005
(Continued)

OTHER PUBLICATIONS

Response to Rule 161(1) and 162 EPC, European Patent Application No. 17808704.5, filed Dec. 20, 2019.
(Continued)

*Primary Examiner* — David R Dunn
*Assistant Examiner* — Danielle Jackson
(74) *Attorney, Agent, or Firm* — Dorf & Nelson LLP; Scott D. Locke, Esq.

(57) ABSTRACT

A portable frame apparatus and associated methods of use are disclosed. The apparatus includes a frame. The frame includes a first support member, a second support member, and at least one connecting member. The connecting member is configured to be coupled to the first support member at a first end of the connecting member and to the second support member at a second end of the connecting member. The first support member, the second support member and the connecting member form a rigid structure that provides support to a user of the portable frame apparatus.

19 Claims, 30 Drawing Sheets

Related U.S. Application Data

(60) Provisional application No. 62/422,642, filed on Nov. 16, 2016.

(51) Int. Cl.
*A47C 16/00* (2006.01)
*A47C 20/02* (2006.01)

(56) References Cited

U.S. PATENT DOCUMENTS 2,773,542 A * 12/1956 Chasin ..... A61G 7/1007 297/411.36
3,098,651 A 7/1963 Murcott
3,442,276 A 5/1969 Edwards et al.
3,516,425 A 6/1970 Rigal
3,668,723 A * 6/1972 Bratton ..... A01N 43/56 5/658
3,840,034 A * 10/1974 Smith ..... A61H 3/00 135/67
4,159,110 A 6/1979 Dodenhoff
4,180,086 A 12/1979 Thomas
4,251,105 A 2/1981 Barker
4,474,202 A 10/1984 Blechner
4,993,446 A 2/1991 Yarbarough
5,226,439 A * 7/1993 O'Keeffe ..... A47C 7/62 135/66
5,347,666 A 9/1994 Kippes
5,433,235 A 7/1995 Miric et al.
5,449,013 A 9/1995 Landers
5,509,152 A 4/1996 Kippes
5,520,597 A 5/1996 Tobin
5,662,396 A 9/1997 Reeder et al.
6,050,644 A * 4/2000 Neal ..... A47C 7/546 297/411.24
6,827,405 B1 12/2004 Roberts
7,373,942 B1 5/2008 Yeager
7,862,122 B1 * 1/2011 Shammas ..... B60N 2/245 297/411.23
8,544,486 B1 10/2013 Hardwick
9,657,770 B2 * 5/2017 Moller ..... A61H 3/04
9,662,252 B1 * 5/2017 Pearson ..... A47K 17/026
2004/0187901 A1 9/2004 Diamond
2008/0128008 A1 6/2008 Obitts et al.
2008/0163913 A1 7/2008 Hsiao
2008/0276977 A1 11/2008 Jowett et al.
2009/0115158 A1 5/2009 Lawrence
2011/0232665 A1 9/2011 Barnett
2011/0272913 A1 11/2011 Diamond
2013/0161135 A1 6/2013 Kim
2013/0291912 A1 11/2013 Kwon
2013/0319488 A1 12/2013 Chiu
2013/0334784 A1 12/2013 Pak et al.
2015/0240849 A1 8/2015 Fang
2015/0320631 A1 11/2015 Bordan
2016/0374890 A1 12/2016 Tsai

FOREIGN PATENT DOCUMENTS

FR 3016124 A1 * 7/2015 ..... A61H 3/04
WO 2018/093905 A1 5/2018

OTHER PUBLICATIONS

International Search Report dated Jan. 29, 2018, for PCT Application No. PCT/US2017/061807, filed Nov. 15, 2017, 4 pages.
Written Opinion dated Jan. 29, 2018, for PCT Application No. PCT/US2017/061807, filed Nov. 15, 2017, 5 pages.

* cited by examiner

PORTABLE FRAME

CROSS-REFERENCE TO RELATED APPLICATIONS

The present application is a continuation application of U.S. patent application Ser. No. 15/813,769, filed on Nov. 15, 2017, which claims priority to U.S. Provisional Patent Application No. 62/422,642, filed on Nov. 16, 2016, the contents of which are hereby fully incorporated by reference.

TECHNICAL FIELD

The subject matter described herein generally relates to a portable frame with armrests, which, by way of a non-limiting example, can be used together with and/or for armless and/or inadequately armed furniture, such as an armless and/or inadequately armed chair, armless and/or inadequately armed couch, armless and/or inadequately armed bed, and/or the like, and/or as a standalone structure, and/or any combinations thereof.

BACKGROUND

A large number of public establishments, such as restaurants, hotels, offices, and waiting rooms at hospitals and clinician offices, use armless or inadequately armed furniture, such as armless or inadequately armed chairs. Armless or inadequately armed furniture is found in many homes as well. The increasing use of armless or inadequately armed furniture is prompted by space and cost savings, and, in some cases, aesthetic considerations. The frequent use of armless or inadequately armed furniture has been detrimental to persons in wheelchairs, who are potentially capable of transferring to a regular seating, as well as persons who use walkers, rollators, or other assistive aids, other handicapped or disabled persons, and the elderly and the infirm. Such persons find it difficult, if not impossible, to gain access to and use such furniture because it lacks armrests which would enable such persons to balance and support themselves while they are seeking to sit down on, or to stand up from, such furniture. To support and balance themselves while attempting to sit or stand, such persons often need to hold onto the armrests of that furniture. Thus, there is a need for a portable frame having armrests, which can be used to easily and/or temporarily modify an armless and/or inadequately armed furniture without using much space while still satisfying aesthetic considerations. The portable frame can also be used for any other purposes, including, but not limited to support, motion, etc.

SUMMARY

In some implementations, the current subject matter relates to a portable frame apparatus. The apparatus can include a frame that can include a first support member and a second support member, and at least one connecting member. The connecting member can be configured to be coupled to the first support member at a first end of the connecting member and to the second support member at a second end of the connecting member. The first support member, the second support member and the connecting member can form a rigid structure that can provide support to a user of the portable frame apparatus.

In some implementations, the current subject matter can include one or more of the following optional features. In some implementations, the connecting member can be rigidly coupled to the first and second support members. In alternate implementations, the connecting member can be rotatably coupled to at least one of the first and second support members.

In some implementations, each support member can include a front portion, a rear portion, a top portion, and a base portion. The front portion can be configured to be coupled to the top and rear portions and the base portion can be configured to be coupled to the top and rear portions and disposed opposite the top portion. The connecting member can be configured to be coupled to the rear portions of the support members.

In some implementations, at least one of the front portion, the rear portion, the top portion, the base portion, and the connecting member can be configured to be expandable.

In some implementations, the user of the portable frame apparatus can be configured to contact at least one of the top portions of the support members during use of the portable frame apparatus.

In some implementations, the front, rear, top, and base portions of each support member can form an integral rigid structure. In alternate implementations, at least one of the front, rear, top, and base portions of one of the support members can include a pivoting joint configured to pivotally connect to another portion of the same support member.

In some implementations, the top portion can include a cover member configured to be coupled to the top portion. The cover member can be configured to provide at least one of the following: a comfort to the user using the portable frame apparatus, preventing slipping by the user during use of the portable frame apparatus, and/or any combination thereof.

In some implementations, the base portion can include a base cover member configured to be coupled to the base portion. The base cover member can be configured provide at least one of the following: increase stability of the portable frame apparatus during use, increase traction of the portable frame apparatus during use and any combinations thereof.

In some implementations, the base portion can include at least one wheel rotatably coupled to the base portion, thereby providing mobility to the portable frame apparatus. Further, the base portion can include at least one braking member configured to apply braking to the at least one wheel to prevent movement of the portable frame apparatus.

In some implementations, the rear portion of each support member can include a first rear portion and a second rear portion. The first rear portions of the first and second support members can be configured to be coupled to a first connecting member. The second rear portions of the first and second support members can be configured to be coupled to a second connecting member. Further, the first and second connecting members can be configured to be separate from each other, thereby creating a gap between the first connecting member and the second connecting member.

In some implementations, a distance between the front portions of the support members can be greater than or equal to a distance between the rear portions of the support members. In alternate implementations, a distance between the top portions of the support members can be less than or equal to a distance between the base portions of the support members. In further alternate implementations, a distance between the front portions of the support members can be greater than or equal to a distance between the rear portions of the support members as well as a distance between the top portions of the support members can be less than or equal to a distance between the base portions of the support members.

In some implementations, the height of the portable frame apparatus is in the range of approximately 20 inches to approximately 30 inches. The width of the portable frame apparatus is in the range of approximately 14 inches to 30 inches. The length of the portable frame apparatus is in the range of approximately 14 inches to 25 inches.

In some implementations, at least a portion of the portable frame apparatus can be manufactured from at least one of the following: aluminum, metal, steel, wood, fiberglass, plastic, alloy, composite material, and/or any combinations thereof.

In some implementations, the portable frame apparatus can be configured to be placed adjacent to an object being used by the user thereby providing arm support to the user. In some implementations, the portable frame apparatus can be configured to provide support to the user while the user is performing at least one of the following: standing, sitting, lying down, exercising, crawling, and any combination thereof.

In some implementations, the portable frame apparatus can include another connecting member. The other connecting member can be separate from the connecting member and can be configured to be separately coupled to the first and second support members.

In some implementations, the portable frame apparatus can be configured to be stackable with at least another portable support apparatus.

In some implementations, at least one dimension of at least one of the first support member, the second support member, and the connecting member can be configured to be adjustable.

In some implementations, the current subject matter relates to a method of using a portable frame apparatus. The method can include providing the portable frame apparatus described above, positioning the portable frame apparatus adjacent to an external object utilized by a user, and providing, using the portable frame apparatus, support to the user while utilizing the external object.

The details of one or more variations of the subject matter described herein are set forth in the accompanying drawings and the description below. Other features and advantages of the subject matter described herein will be apparent from the description, the drawings, and the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

DETAILED DESCRIPTION

To address the above and potentially other deficiencies of currently available solutions, one or more implementations of the current subject matter provide methods, systems, articles or manufacture, and the like that can, among other possible advantages, provide systems, devices, and associated methods for a portable support frame with one or more armrests.

Figure 1A:
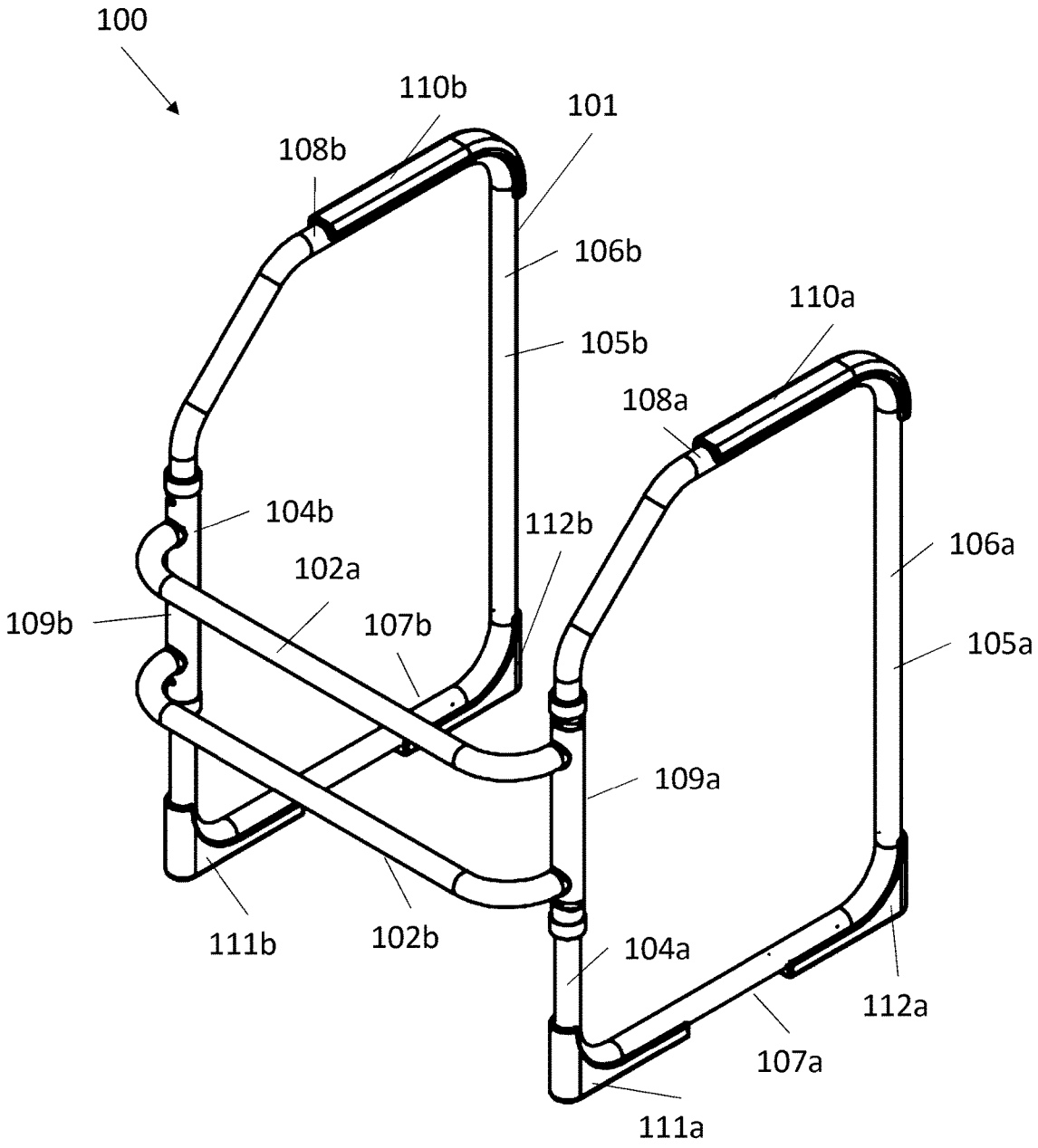
FIGS. 1A-1I illustrate various views of an exemplary portable frame support apparatus, according to some implementations of the current subject matter.
Figure 1B:
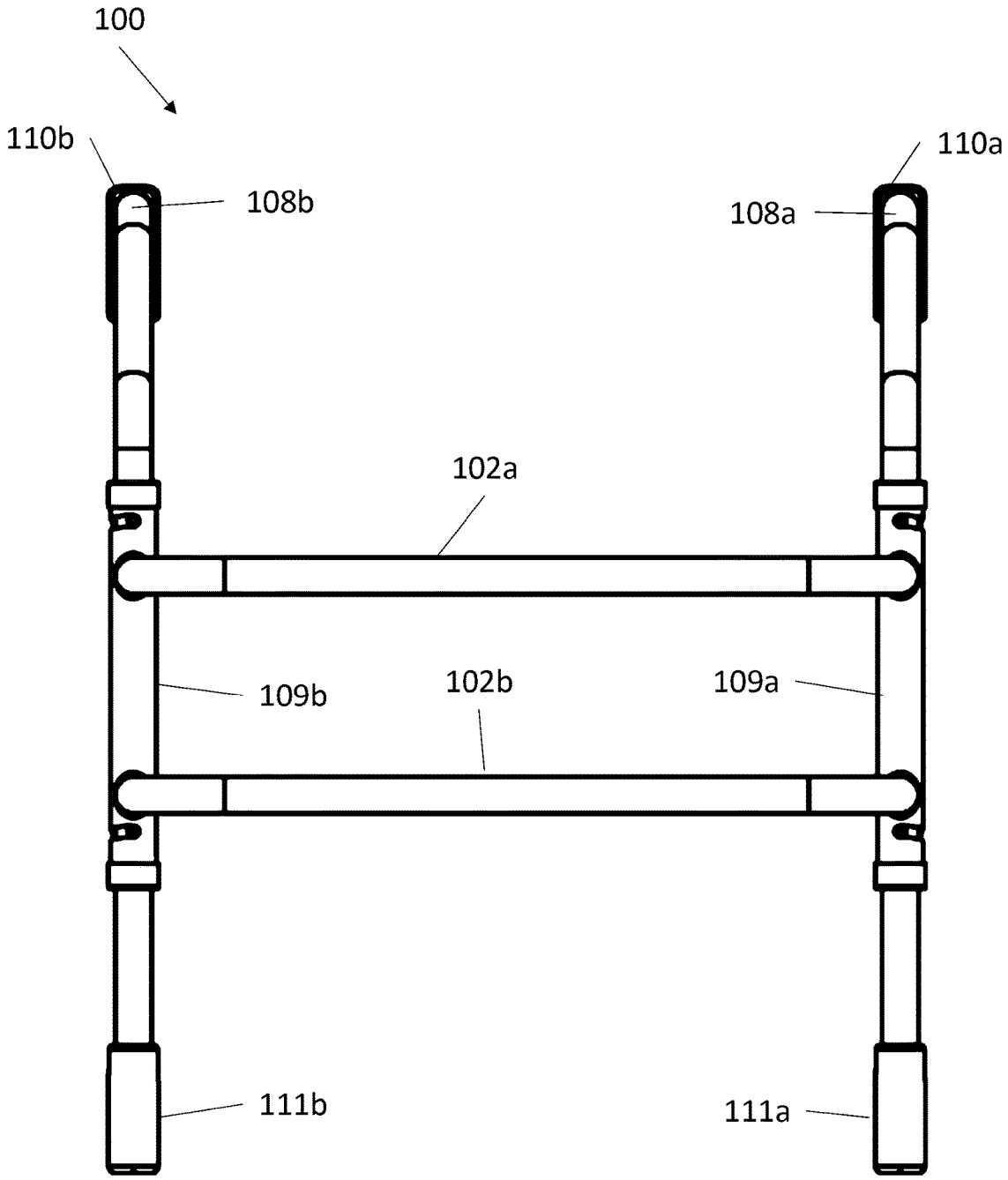
Figure 1C:
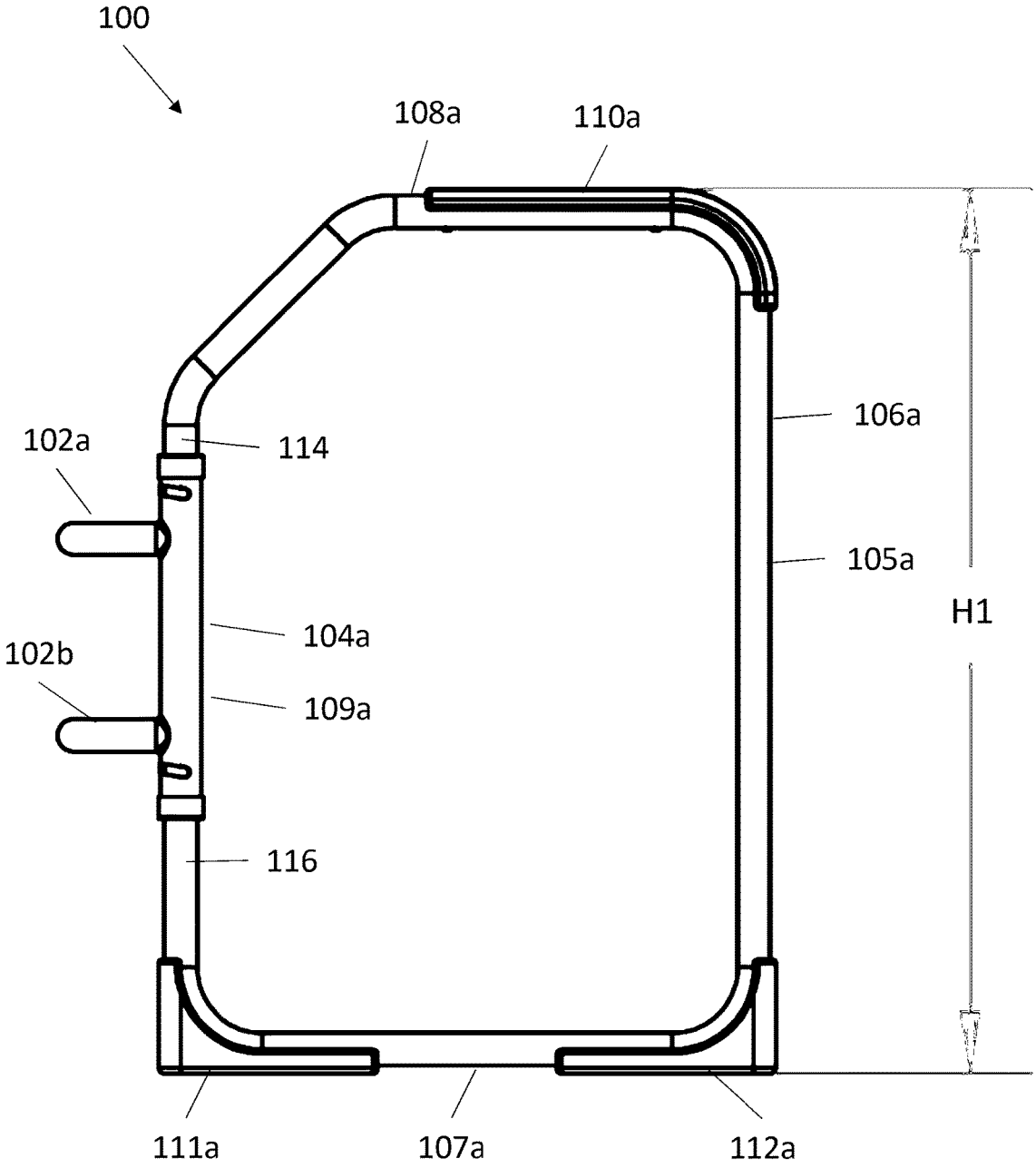
Figure 1D:
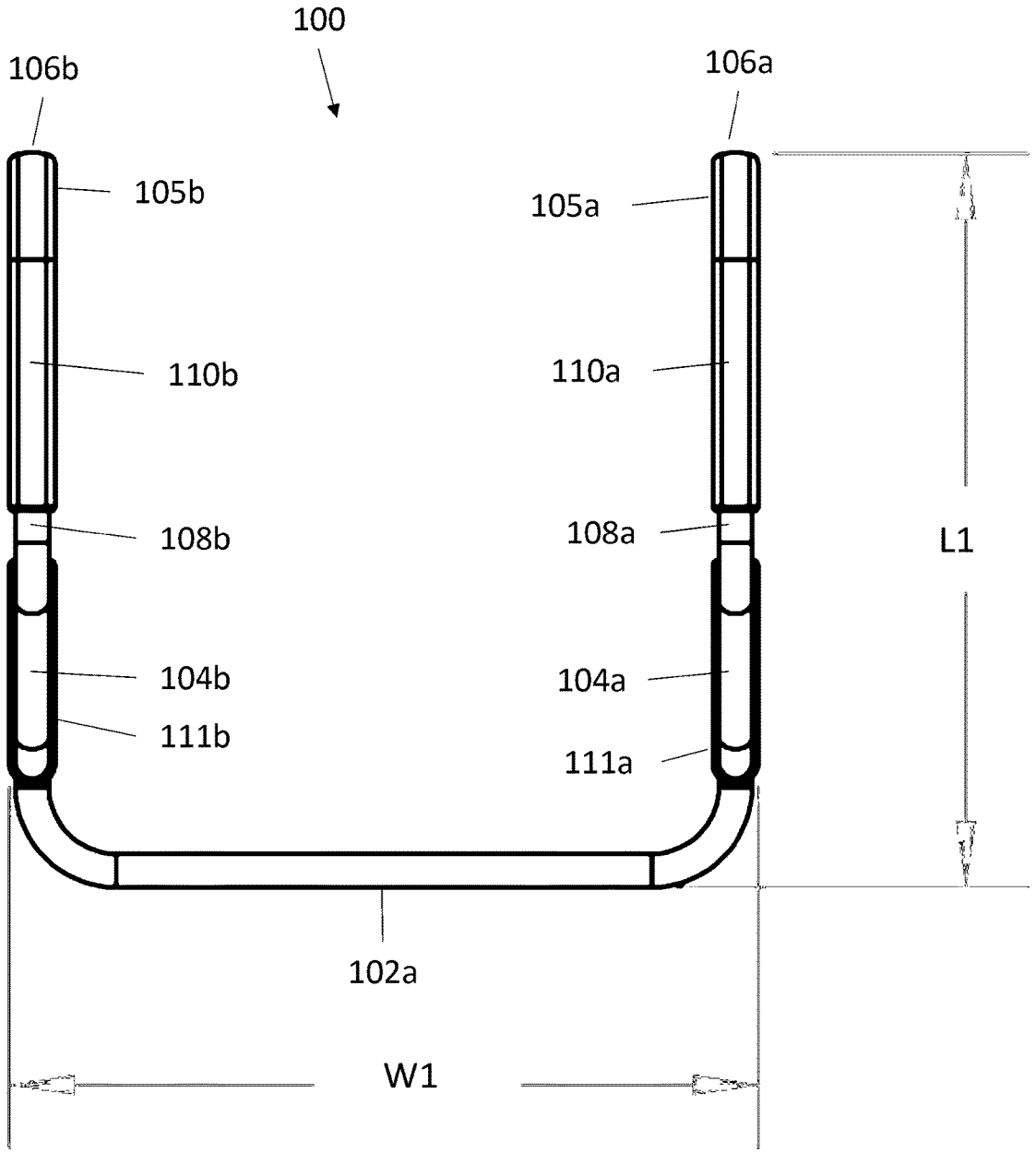
Figure 1E:
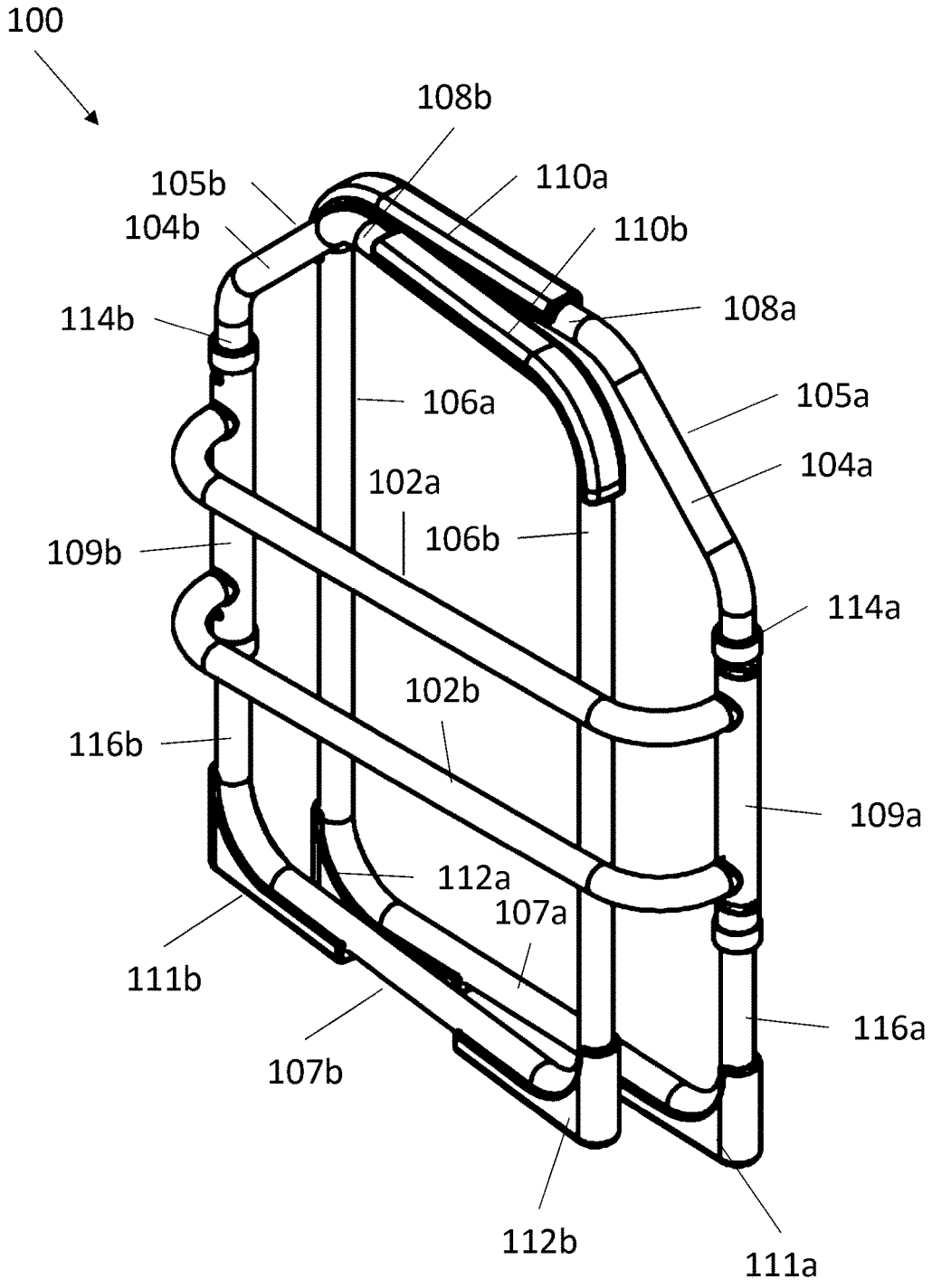
Figure 1F:
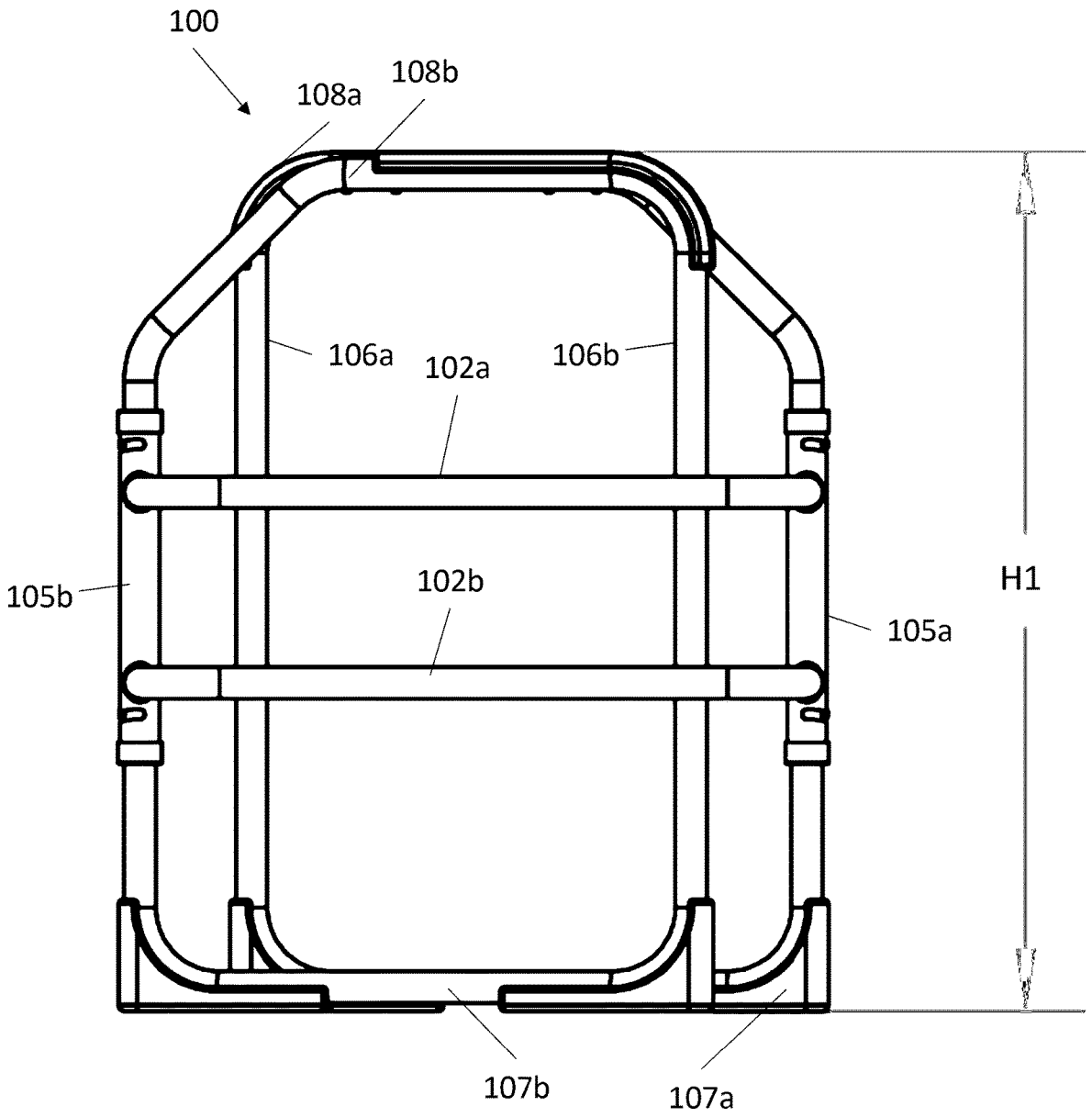
Figure 1G:
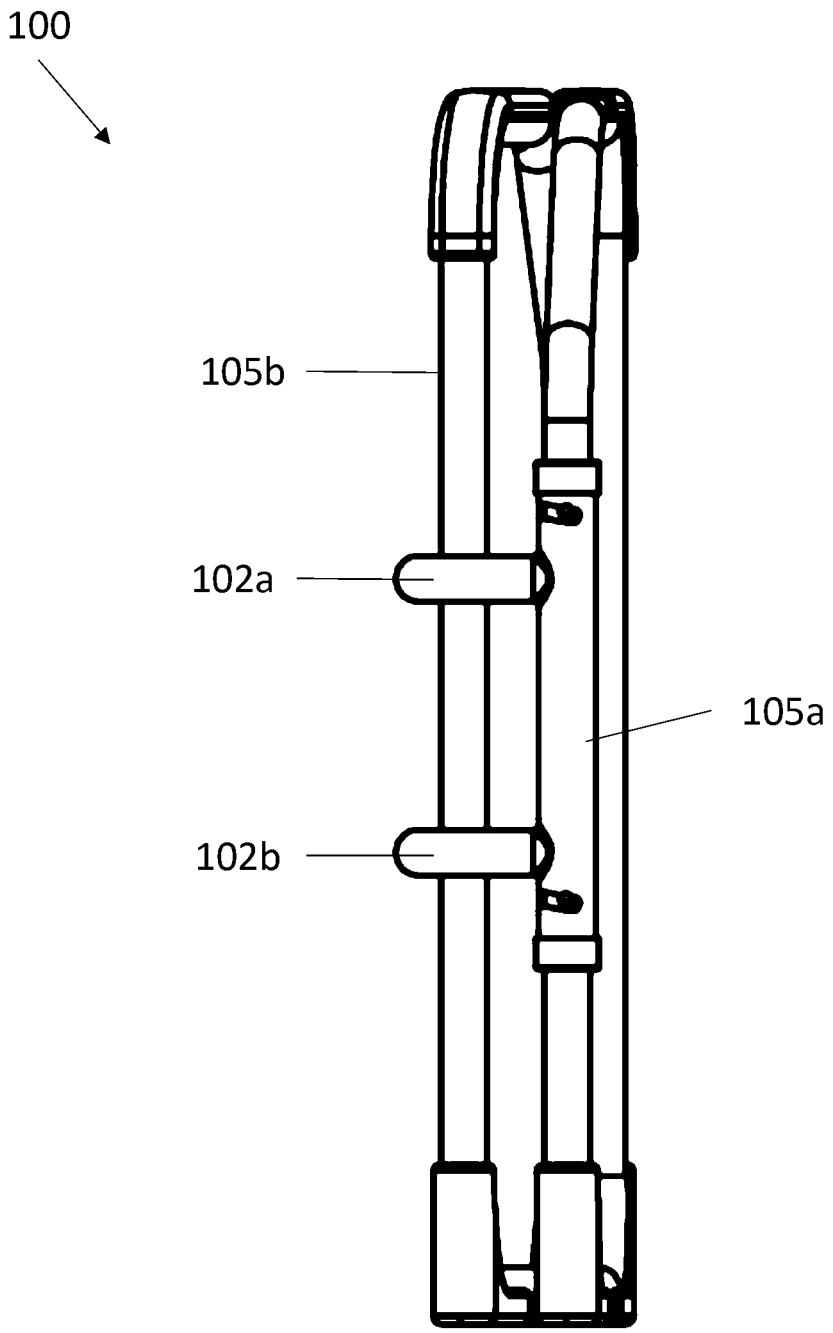
Figure 1H:
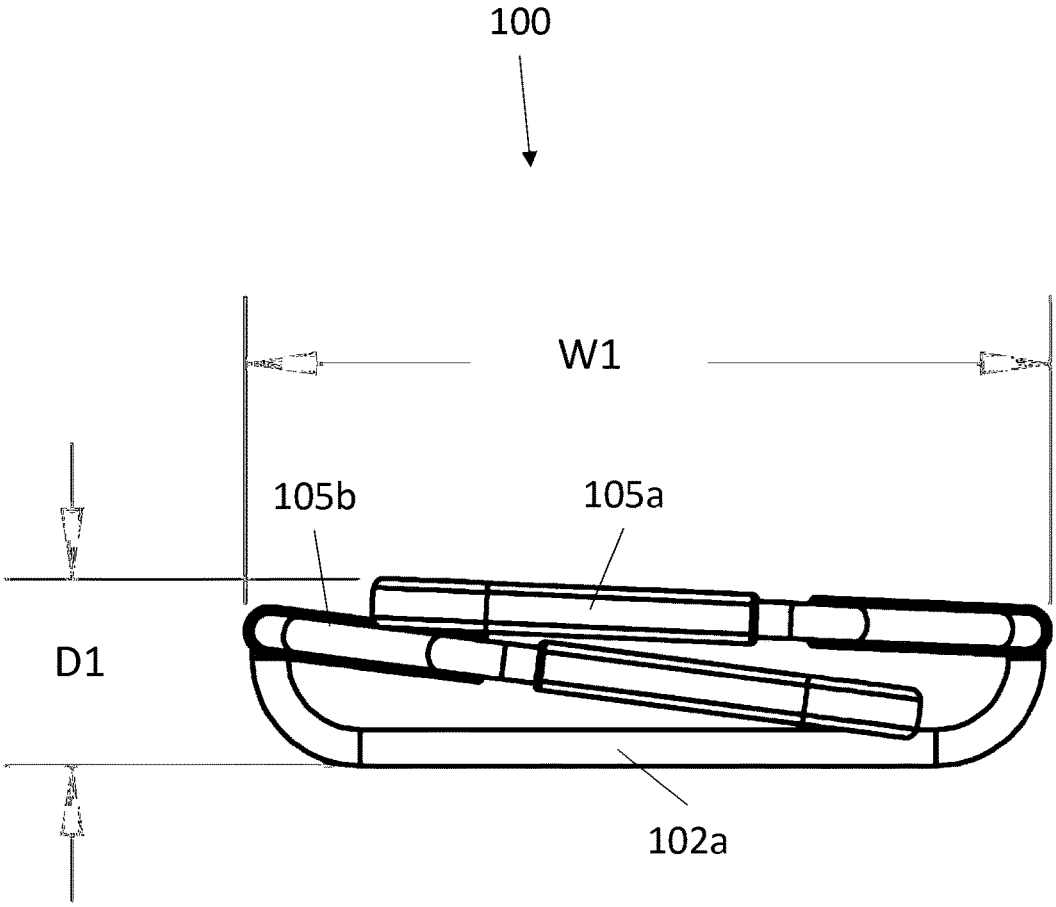

FIGS. 1A-1I illustrate an exemplary portable support frame apparatus 100, according to some implementations of the current subject matter. FIG. 1A illustrates a perspective view of the apparatus 100; FIG. 1B illustrates a rear view of the apparatus 100; FIG. 1C—a side view of the apparatus 100; FIG. 1D—top view of the apparatus 100; FIG. 1E—a folded perspective view of the apparatus 100; FIG. 1F—a folded rear view of the apparatus 100; FIG. 1G—a folded side view of the apparatus 100; FIG. 1H—a folded top view of the apparatus 100; and FIG. 1I—an exploded perspective view of the apparatus 100

Referring to FIG. 1A, the apparatus 100 is shown in an expanded (e.g., unfolded) state. The apparatus 100 can include a frame 101, which in turn, can include a first support member 105*a*, a second support member 105*b*, and at least one connecting member 102 (*a, b*). As shown in FIG. 1A, the apparatus 100 can include two connecting members 102. Alternatively, a single and/or multiple connecting members 102 can be used. Further, the apparatus 100 can include one or more support members 105 (i.e., the current subject matter is not limited to two support members shown in FIG. 1A). The connecting member 102 can be configured to couple to the first support member 105*a* and to the second support member 105*b* using a connection 109 (*a, b*), respectively. In some implementations, the coupling and/or connection 109 (*a, b*) of the connecting member 102 to the support members 105 can be fixed and/or pivotal. If the coupling is fixed, then the connecting member 102 can be rigidly connected to one or more support members 105, thereby not allowing any rotational movement of the connecting member 102 around one or more portions of the support member 105 (alternatively, the support member can at least partially rotate around the support member 102 using a pivotal connection 109). If the coupling is pivotal, the connecting member 102 can be configured to rotate at least partially around the support member 105. In some exemplary implementations, the rotational movement around the support member 105 can be limited using a stopper mechanism (not shown in FIG. 1A) and/or any other mechanism. Alternatively, the rotation of the connecting member can be limited upon folding or collapsing of the apparatus 100, as shown in FIGS. 1E-G.

The support member 105 (the support members 105*a* and 105*b* are similar, and thus, the "a" or "b" designation may be, at times, omitted in the following discussion) can include a rear portion 104, a front portion 106, a base or bottom portion 107, and a top portion 108. The bottom portion 107 can be configured to be coupled to the rear and front portions 104, 106, and the top portion 108 can be configured to be positioned opposite of the base portion 107 and can also be configured to be coupled to the rear and front portions 104, 106. One or more of the portions 104, 106, 107, 108 can be straight, curved, slanted (as shown, for example, in FIG. 1A), bent, etc. Further, the portions 104 and 106 can be configured to be disposed substantially perpendicular to the portions 107, 108. Alternatively, one or more of the portions 104, 106 can be disposed at any angle with respect to one or more of the portions 107, 108 in any plane (i.e., x-y-z coordinate system).

In some implementations, the portions 104, 106, 107, 108 can be configured to form an integral rigid structure. Alternatively, one or more of the portions 104, 106, 107, 108 can be configured to be pivotally coupled to one or more of the respective other portions 104, 106, 107, 108 using a pivotal joint (not shown in FIG. 1A). Such pivotal connections, for example, can allow folding of the apparatus 100 for storage, transport, etc.

In some implementations, the support members 105 can include cover members 110, 111, and 112. The cover member 110 can be configured to be coupled to the top portion 108, whereby a user of the apparatus 100 can be configured to place user's arms on top of the cover members 110 during use (e.g., while sitting on a chair around which the apparatus 100 is placed). The cover member 110 can include a cushion and/or a padding that can provide comfort to the user during use (e.g., the user can use the top portion 108 with cover member 110 as an armrest). Further, the cover member 110 can be manufactured from a slip-resistant material (e.g., leather, cloth, plastic, vinyl, etc.) that can prevent slippage of the user's arms during use (e.g., while sitting, standing up, etc.).

The cover members 111 and 112 can be configured to be coupled to the base portion 107 and can be configured to contact a surface on which the apparatus 100 is placed. The cover members 111, 112 can be also manufactured from a slip-resistant materials (e.g., rubber, plastic, etc.) that can provide stability and slip-resistance to the apparatus 100 while in use. The cover members 110-112 can be attached to the respective portions 107, 108 using any mechanisms (e.g., glue, welding, bolt(s), screw(s), VELCRO®, etc.). Alternatively, the members 110-112 can be integral with the respective portions 107, 108 (e.g., base portion 107 can be made with appropriate slip-resistant portions, etc.). In some implementations, the cover members 111, 112 can be used to protect the base portion 107 from damage (e.g., scratching, dents, etc.) whether during use and/or storage. In some implementations, a single and/or multiple cover portions covering the base portion 107 can be used. For example, the single cover portion can be configured to be disposed along the bottom of the base portion 107 from one end of the base portion 107 to the other end of the base portion 107. Further, the cover members 111, 112 can be configured to provide a balance to the apparatus 100 during use.

Figure 4A:
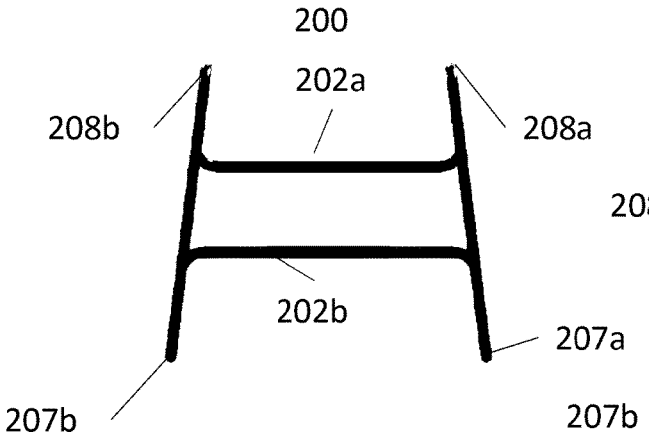
FIGS. 4A-4C illustrate various views of another exemplary nesting portable frame support apparatus, according to some implementations of the current subject matter.
Figure 4B:
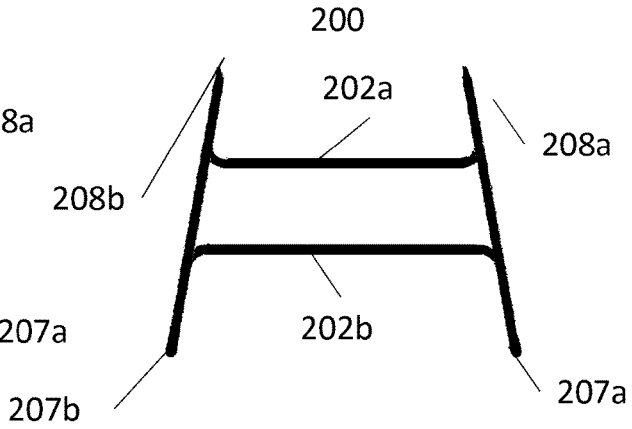
Figure 4C:
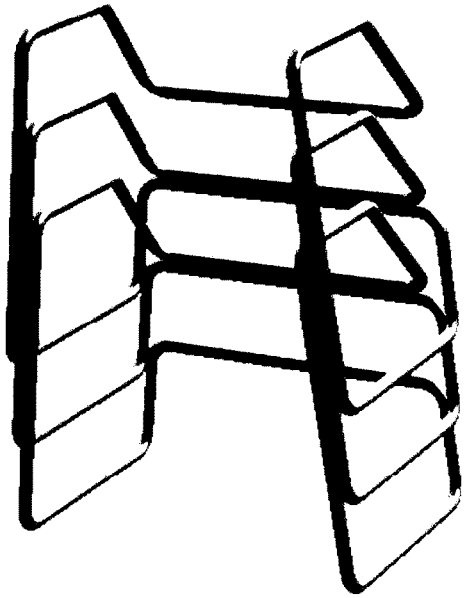

In some implementations, as stated above, the connecting member 102 can be configured to be coupled to the support portions 105, thereby providing a connection between the portions 105. The connecting member 102 can be configured to be perpendicularly disposed with regard to the rear portion 104, whereby the front portions 106 as well as the rear portions 104 are configured to be equidistant from each other. Alternatively, the connecting member 102 can be configured to be coupled to the rear portion 104 at an angle, as for example is shown in FIG. 2C, whereby the distance between the front portions 106 is greater than the distance between the rear portions 104, or as shown in FIGS. 4A-4C, whereby the distance between the top portions 108 is less than the distance between the base portions 107 (which can allow for stacking of one or more apparatuses 100).

In some implementations, the connecting member 102 can be configured to have a curved shape (e.g., a u-shape). This can allow for a "deeper" placement of the apparatus 100 around an object (e.g., a chair). As shown in FIG. 1A, the connecting member 102 can have curved portions adjacent to its connections to the support members 105. In some implementations, the curvatures can be disposed at any location on the connecting member 102. In alternate implementations, the connecting members 102 can have a straight shape.

In some implementations, the support members 105 and/or the connecting member 102 can be manufactured using tubes, bars, rods, poles, sticks, etc., and/or any combination thereof (hereinafter, "bars"). The bars (or one or more portions thereof) can have circular, square, rectangular, triangular, polygonal, and/or other desired cross-section. The bars (or one or more portions thereof) can be hollow, solid, partially hollow, partially solid, and/or any combination thereof. In some implementations, the bars (or one or more portions thereof) can be manufactured from aluminum, metal, steel, wood, fiberglass, plastic, alloys, composite materials, and/or any other materials, and/or any combination thereof. By way of a non-limiting example, using aluminum for the bars (or one or more portions thereof) can be advantageous for manufacturing, as aluminum can be highly malleable and elastic, and thus, is easy to bend and allows a deeper or more intricate metal-spinning; using steel for the bars (or one or more portions thereof) can be advantageous as steel can be tough, resilient, etc.

In some implementations, during use, the apparatus 100 (in the state shown in FIG. 1A) can be positioned around an object, such as a chair (e.g., an armless and/or inadequately armed/arm-rested chair, etc.) with the connecting member 102 being positioned to be behind and/or substantially adjacent the back of the chair and the support members 105 being placed adjacent each side of the chair. This can provide the user of the apparatus 100 with an ability to use top portions 108 of the support members 105 as armrests, such as while sitting in the chair (i.e., the user can choose to rest arms on the top portions 108 (or cover members 110, if the apparatus 100 is so equipped)), and/or as support, such as when sitting down and/or getting up from the chair (e.g., the user can choose to place hands on the top portions 108 (or cover members 110, if so equipped) and prop him/herself when sitting down/getting up). While the user is using the apparatus 100, the cover members 111, 112 can be configured to provide stability and/or anti-slippage to the apparatus 100 by preventing movement (e.g., slipping, wobbling, etc.) of the apparatus 100 on the surface (e.g., floor) on which the apparatus 100 is being positioned.

FIG. 1B illustrates a rear view of the apparatus 100 in the expanded (e.g., unfolded) state. As shown in FIG. 1B, the cover members 111 can be configured to cover portions of the rear portions 104 as well as the base portions 107 (as shown in FIG. 1A).

Further, the connections 109 can be configured to be hollow tubes that can be fixed to the connecting member 102 and further configured to cover at least a part of the rear portions 104. The rear portions 104 can be configured to be inserted through the connections 109 to allow for rotation of the rear portions 104 inside the connections 109, whereby an internal cross-sectional diameter of the connections 109 can be larger than an outer cross-sectional diameter of the rear portions 104. The rear portions 104 and/or connections 109 can include one or more stoppers to prevent sliding of the connections 109 along the rear portions 104.

FIG. 1C illustrates a side view of the apparatus 100 in the expanded (i.e., unfolded) state. As shown in FIG. 1C, the rear portion 104*a* can include height-adjusting portions 114 and 116. The portion 114 can be configured to be positioned above the connection 109 and the portion 116 can be configured to be positioned below the connection 109. The portions 114 and 116 can be configured to cause adjustment of the height H1 of the support member 105 (as can be understood, the front portion 106 can include similar elements that can be used together with the portions 114, 116 for adjusting height of the support member 105).

The portions 114 and 116 can be configured to slide in and out of the connection 109 for the purposes of adjusting height of the support member 105. For example, one or more of the portions 114 and 116 can include multiple elements (e.g., multiple male elements, such as protruding elements, etc.) disposed along the length of these portions. Each of those multiple elements (e.g., male elements, such as protruding elements) can be configured to interact, attach, and/or mate with corresponding counterpart elements (e.g., female elements, such as holes) in the connection 109 for the purposes of locking and/or unlocking the connection 109 to the rear portion 104. Such attachment mechanism can allow varying the length of the at least one portion 114, 116 that protrudes outside of the connection 109, thereby varying the height H1 of the support member 105. In alternate implementations, one or more of portions 114, 116 can include a single element (e.g., a male element, such as a protruding element) that can interact, attach and/or mate to one of the multiple corresponding counterpart elements (e.g., female elements, such as holes) along a length of the connection 109.

In some implementations, the height H1 of the support member 105 can be varied by adjusting the height of the cover member 110 (e.g., when the rear portions 104 are fixedly coupled to the connection 109). In this case, the cover member 110 can be pulled in an upward direction away from the top portion 108 (e.g., using one or more sliding rods that may be coupled to the bottom of the cover member 110 and the top of the top portion 104). Similarly, the height H1 of the support member 105 can be adjusted by adjusting the height of the cover members 111, 112. The variation in the height H1 can be useful when the apparatus 100 is used with armless furniture of varying heights.

In some exemplary, non-limiting implementations, the height H1 can correspond to the distance between a top of the cover member 110 to the bottom of the cover members 111, 112. If the apparatus 100 is used to accommodate an object that is used by the user for sitting purposes (e.g., a chair in a restaurant, etc.), height H1 can be in the range of approximately 25 inches to approximately 30 inches. In some exemplary implementations, the height can be in the range of approximately 26 inches to approximately 28 inches. By way of a further non-limiting example, the height H1 can be 27 inches. In non-limiting example of the chair, the dimension H1 can also depend on the height of a seat portion of the chair with which the apparatus 100 is being used. Alternatively, any other value of height H1 can be used.

FIG. 1D is the top view of the apparatus 100 in the expanded (i.e., unfolded) state. As shown in FIG. 1D, the apparatus 100 can have a width W1 (i.e., a distance between outer edges of the support members 105). In some exemplary, non-limiting implementations, the width W1 can be in the range of approximately 14 inches to approximately 30 inches. In further exemplary, non-limiting implementations, the width W1 can be in the range of approximately 21 inches to approximately 23 inches (e.g., for an adult chair). By way of a further non-limiting example, the width W1 can be 22.4 inches.

The apparatus 100 can have a length L1 (i.e., a distance between an outer edge of the connecting member 102 and an outer edge of the front portion 106). In some exemplary, non-limiting implementations, the length L1 can be in the range of approximately 14 inches to 25 inches. In further exemplary, non-limiting implementations, the length L1 can be in the range of approximately 21 inches to approximately 23 inches (e.g., for an adult chair). By way of a further non-limiting example, the length L1 can be 21.9 inches.

In some exemplary, non-limiting implementations, the width W1 and the length L1 can have any other values as long as the ratio of width/height (i.e., W1/L1) remaining equal to or substantially equal to (e.g., within −0.25 and +0.25 of) 22.4/21.9. In yet another exemplary, non-limiting implementations, the width W1 and the length L1 can have any other value with the ratio of width/height (i.e., W1/L1) having any other value. The dimensions for width W1 and length L1 can depend on the dimensions of the armless furniture with which the apparatus 100 is being used.

In some implementations, similar to the adjustability of the height H1 of the apparatus 100, the width W1 and the length L1 can also be adjustable. For example, to adjust the width W1, the connecting member 102 can include an extension mechanism (e.g., a telescoping extension, a lockable extension, etc.) that can allow for increasing and/or decreasing the width W1 to a desired width (e.g., to accommodate the object with which the apparatus 100 is being used). Similarly, the length L1 can be adjusted using an extension mechanism disposed in the top and base portions 108, 107 (as shown in FIG. 1A).

FIGS. 1E-1H illustrate the apparatus 100 in a folded state. FIG. 1E illustrates the perspective view of the apparatus 100 in the folded state. FIG. 1F illustrates a rear view of the apparatus 100 in the folded state. FIG. 1G illustrates a side view of the apparatus 100 in the folded state. FIG. 1H illustrates a top view of the apparatus 100 in the folded state. To achieve the folded state, one of the support members 105*b* (or the support member 105*a*) can be rotated using the pivotal connection 109*b* to align the support member 105*b* along and adjacent the connecting members 102 (*a, b*). Then, the other support member 105*b* (or the support member 105*b*) can be rotated using the pivotal connection 109*b* to align the support member 105*a* adjacent the rotated support member 105*b*, as shown in FIG. 1E. In some implementations, a locking mechanism (e.g., disposed in the connections 109) can be used to temporarily lock the folded positions of the support members 105.

As shown in FIG. 1H, in the folded state, the apparatus 100 can have a width D1, which can correspond to a distance between an outer edge of the connecting member 102 to an outer edge of the support member 105*a* in the folded state. In some implementations, the dimension D1 of the apparatus 100 in the folded state can be approximately 5.2 inches. In alternate implementations, the dimension D1 of the apparatus 100 in the folded state can have any other value. The folding can advantageously allow the apparatus 100 to become compact for storage purposes, thereby saving space when stored.

Figure 1I:
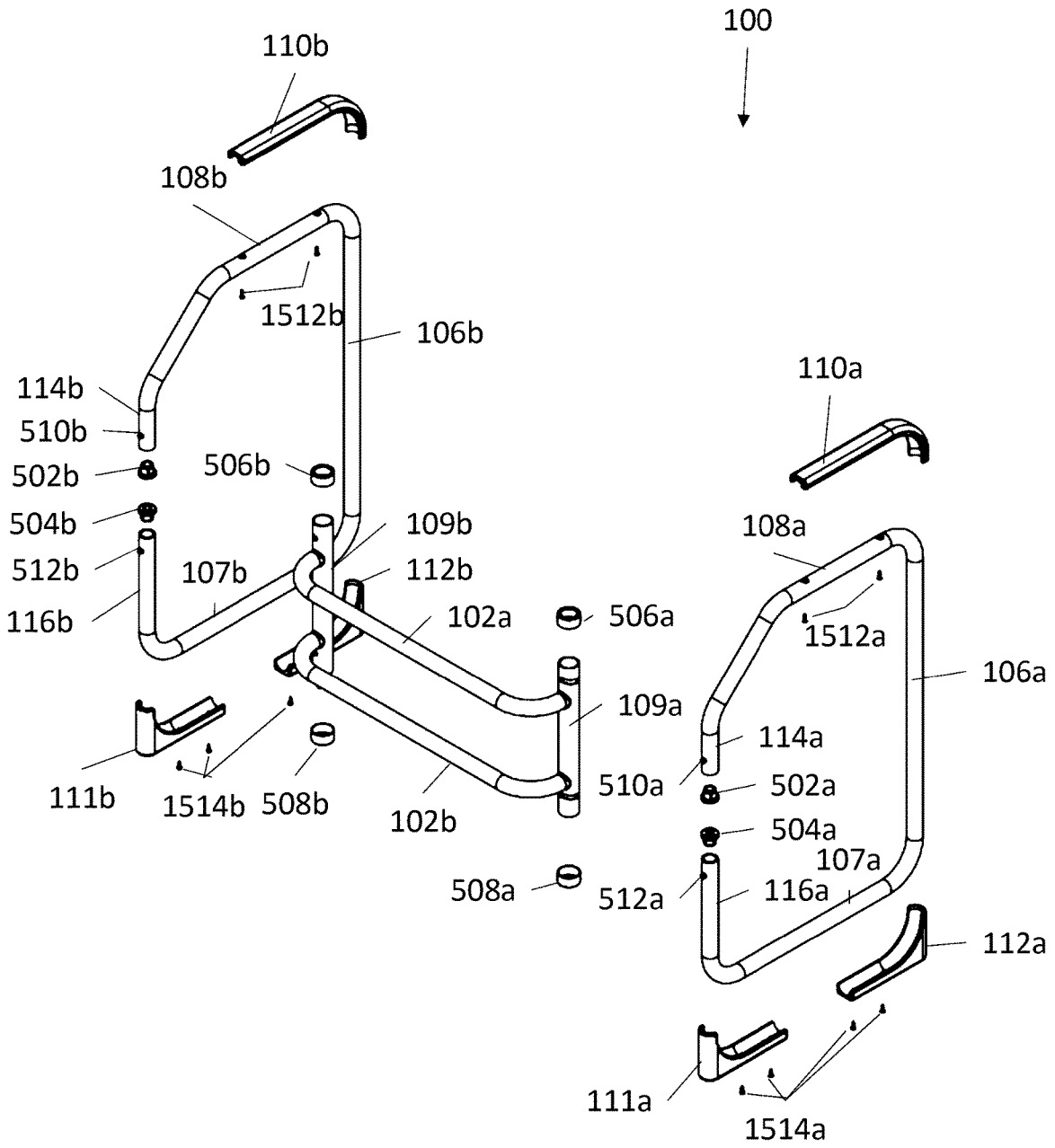

FIG. 1I illustrates an exploded view of various components of the apparatus 100. The connecting members 102 can be configured to be coupled to the connections 109 using one or more attachment mechanisms such that the connecting members 102 and connection 109 form an integral rigid structure. The attachment mechanisms can include at least one of the following: welding, screwing, gluing, stitching, and/or any other attachment mechanisms, and/or any combination thereof. Alternatively, the connecting members 102 and the connection 109 can be so molded during manufacture as to form a single integral structure.

Figure 5A:
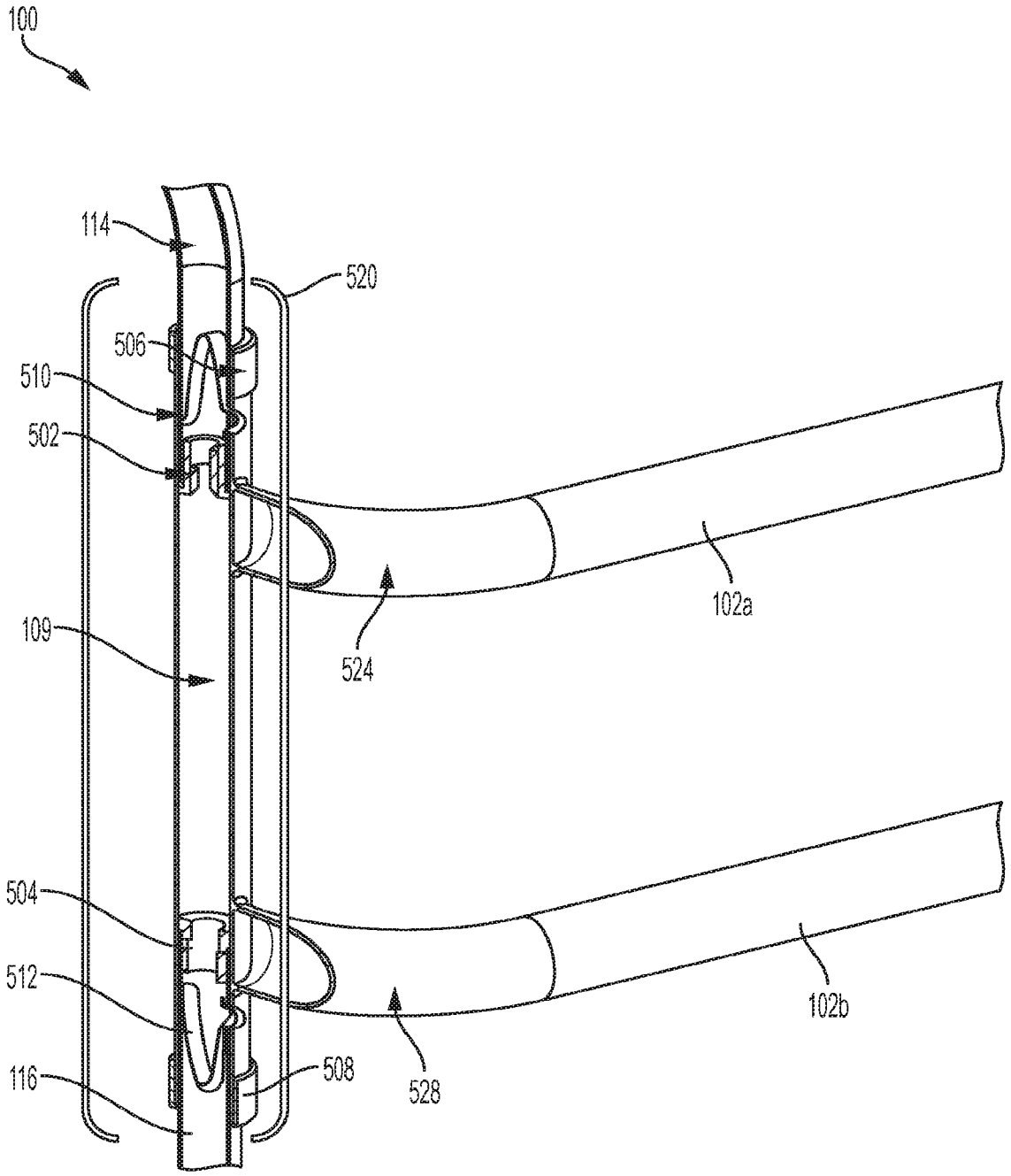
FIGS. 5A-5B illustrate portions of the exemplary portable frame support apparatus, according to some implementations of the current subject matter.

To enable rotation of the support members 105 in the connection 109 and to enable fitting of the portion 114 into the connection 109 (and hence, rotation of the portion 114 in the connection 109), an inner bushing 502 (*a, b*) can be fitted inside the portion 114 of the rear portion 104, as, for example, shown in FIG. 5A. Similarly, To enable rotation of the portion 116 of the rear portion 104 in the connection 109 and to enable fitting of the portion 116 in the connection 109, an inner bushing 504 (*a, b*) can be fitted inside the portion 116 of the rear portion 104, as, for example, shown in FIG. 5A. As shown in FIG. 1I, the portions 114 and 116 do not connect to one another, thereby forming a gap, which can have a length that is approximately equal to the length of the connection 109. Alternatively, the portions 114 and 116 can be configured to connect to one another and form an integral rear portion 104, whereby both portions 114 and 116 can be configured to be placed inside the connection 119 and rotate therein.

An outer pivot bushing 506 (*a, b*) can be configured to be coupled at one end of the connection 109 (as shown in FIG. 1I, the pivot bushing 506 can be coupled to the top of the connection 109). The bushing 506 can have a larger diameter than the diameter of the portion 114. The bushing 506 can be configured to further secure the portion 114 once the portion 114 is inserted into the connection 109 and locked using a spring pin 510 (*a, b*), as, for example, shown in FIGS. 5A and 5B. In some implementations, the bushings 506 can be used to provide alignment and/or bearing surfaces for the connection 109. Similarly, an outer pivot bushing 508 (*a, b*) can be configured to be coupled at the other end of the connection 109 (as shown in FIG. 1I, the pivot bushing 508 can be coupled to the bottom of the connection 109). The bushing 508 can have a larger diameter than the diameter of the portion 116. The bushing 508 can be configured to further secure the portion 116 once the portion 116 is inserted into the connection 109 and locked using a spring pin 512 (*a, b*), as, for example, shown in FIGS. 5A and 5B In some implementations, similar to bushings 506, bushings 508 can be used to provide alignment and/or bearing surfaces for the connection 109.

Referring back to FIG. 1I, the cover members 110 can be attached to the top portions 108 using screws 1512 (*a, b*). While screws can be used for attaching the cover members 110 to the top portions 108, in alternate implementations, any other attachment mechanisms can be used, including, but not limited to, welding, gluing, stitching, any other attachment mechanisms, and/or any combinations thereof. The cover members 111 and 112 can be attached to the base portions 107 using screws 1514 (*a, b*). While screws can be used for attaching the cover members 111, 112 to the base portions 107, in alternate implementations, any other attachment mechanisms can be used, including, but not limited to, welding, gluing, stitching, any other attachment mechanisms, and/or any combinations thereof.

As can be understood, components of the apparatus 100 can be manufactured, packaged, and/or shipped separately, in disassembled form, in assembled form, and/or in any other fashion. A user of the apparatus 100 can be provided with appropriate instruction for assembly of the apparatus 100.

Figure 2A:
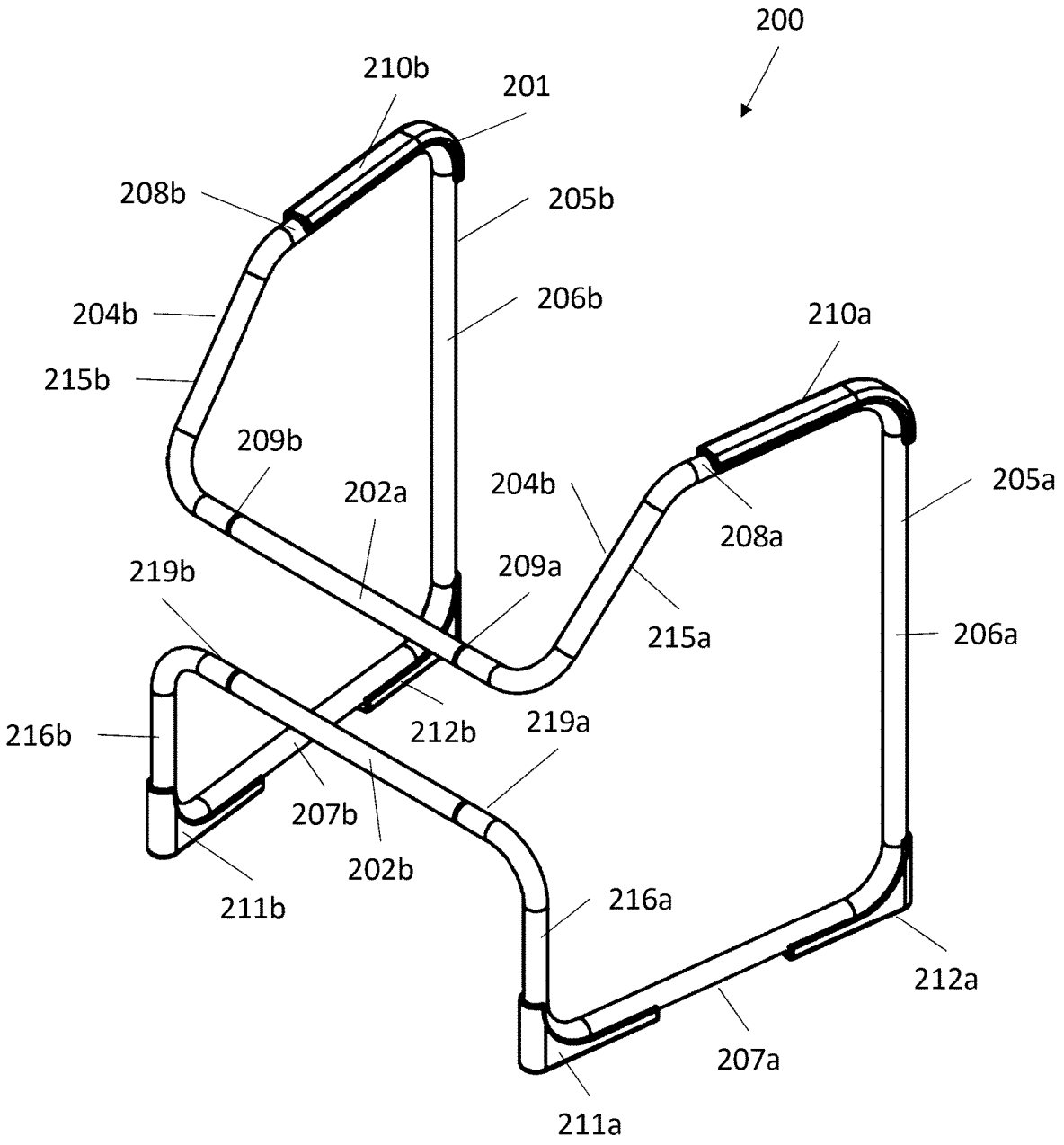
FIGS. 2A-2E illustrate various views of another exemplary portable frame support apparatus, according to some implementations of the current subject matter.
Figure 2B:
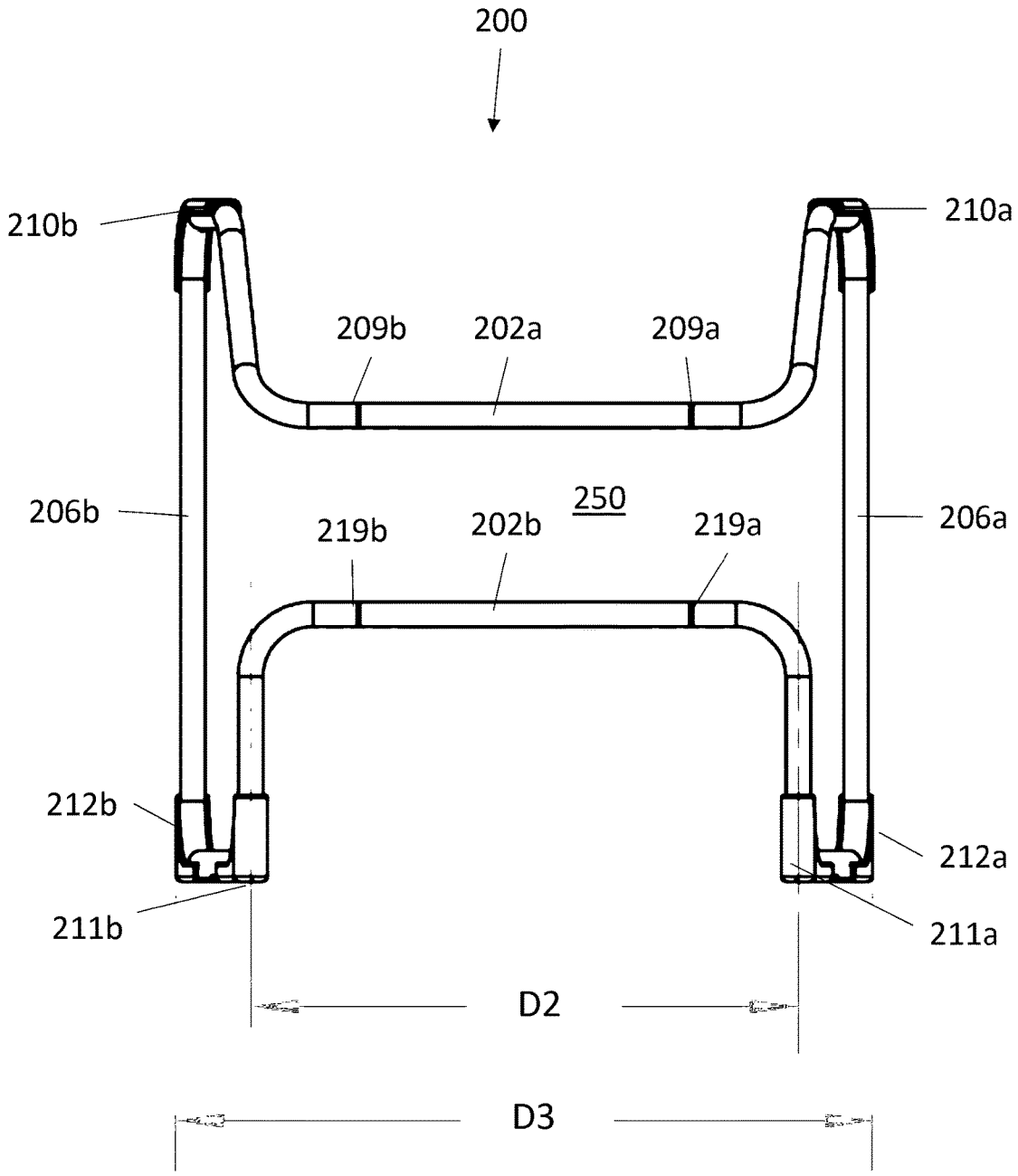
Figure 2C:
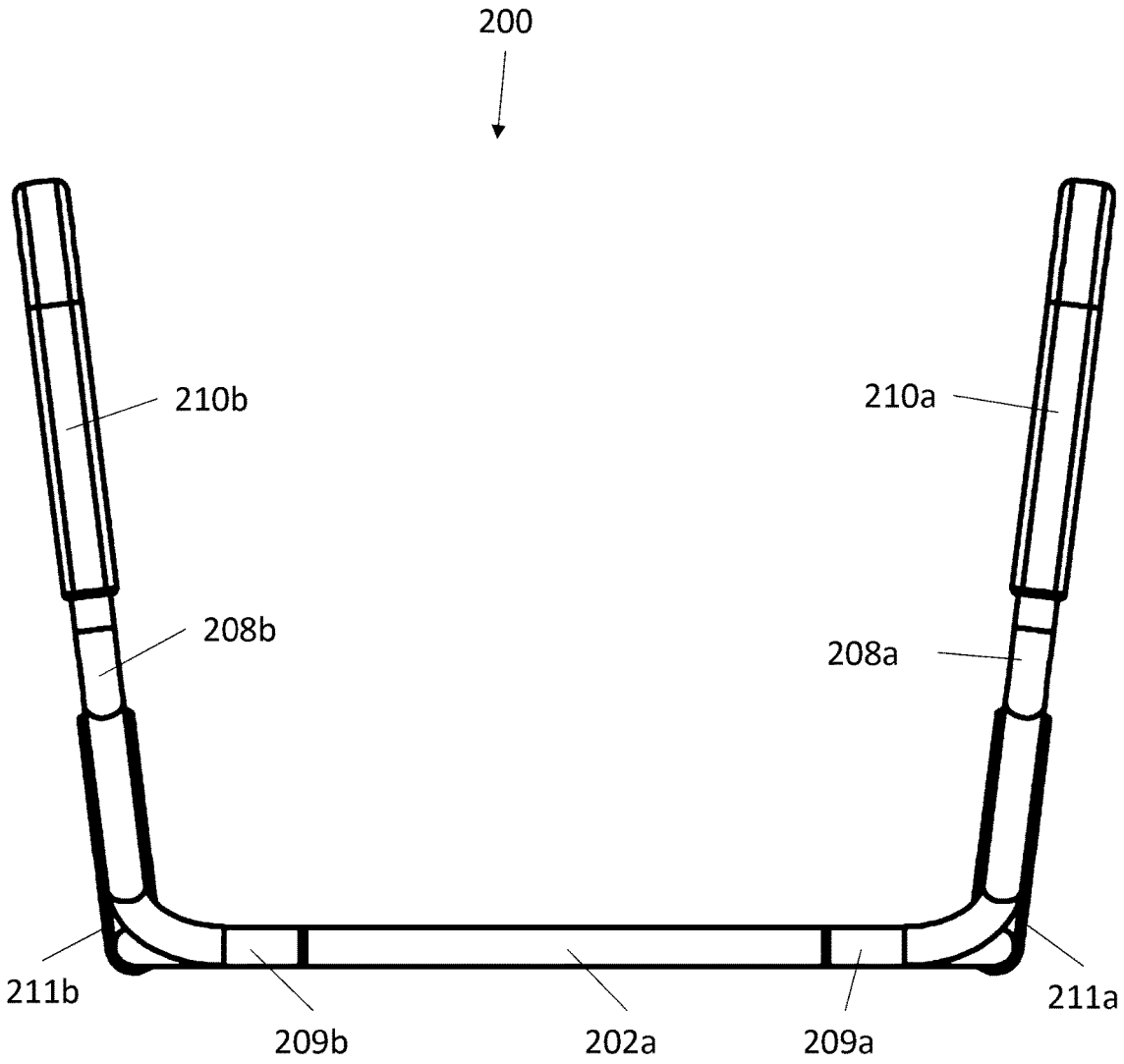
Figure 2D:
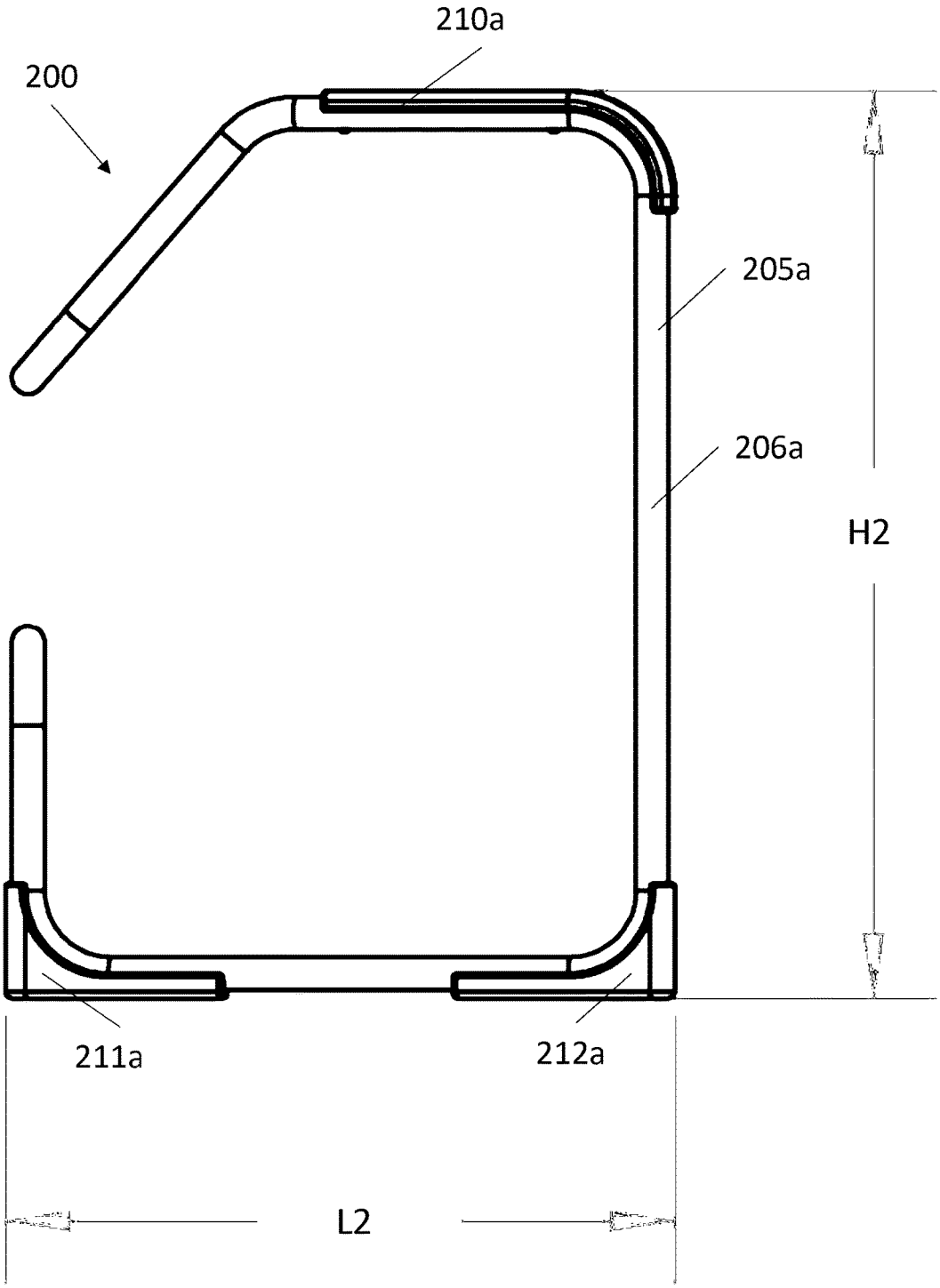

FIGS. 2A-2E illustrate another exemplary portable support frame apparatus 200, according to some implementations of the current subject matter. In some implementations, the support frame apparatus 200 can be non-foldable. In particular, FIG. 2A illustrates a perspective view of the apparatus 200; FIG. 2B illustrates a rear view of the apparatus 200; FIG. 2C—a top view of the apparatus 200; FIG. 2D—a side view of the apparatus 200; FIG. 1E—an exploded perspective view of the apparatus 200

Referring to FIG. 2A, the apparatus 200 can include a frame 201, which in turn, can include a first support member 205*a*, a second support member 205*b*, and at least one connecting member 202 (*a, b*). As shown in FIG. 2A, the apparatus 200 can include two connecting members 202. Alternatively, a single and/or multiple connecting members 202 can be used. Further, the apparatus 200 can include one or more support members 205 (i.e., the current subject matter is not limited to two support members shown in FIG. 2A). As shown in FIG. 2A, the connecting members 202 can be configured to couple to the first support member 205*a* and to the second support member 205*b* using connections 209 (*a, b*) and 219 (*a, b*), respectively. The connecting member 202 can be rigidly connected to one or more support members 205, thereby providing structural rigidity to the frame 201. As shown in FIG. 2A, connection 209*a* can be configured to connect connecting member 202*a* to a first rear portion 215*a* of the support member 205*a*; connection 219*a* can be configured to connect connecting member 202*b* to a second rear portion 216*a* of the support member 205*a*; connection 209*b* can be configured to connect connecting member 202*b* to a first rear portion 215*b* of the support member 205*b*; and connection 219*b* can be configured to connect connecting member 202*b* to a second rear portion 216*b* of the support member 205*b*.

The support member 205 (because the support members 205*a* and 205*b* are similar, the "a" or "b" designation may be, at times, omitted in the following discussion) can include a rear portion 204, a front portion 206, a base or bottom portion 207, and a top portion 208. The rear portion 204 can include a first or top rear portion 215 and a second or bottom rear portion 216. The bottom portion 207 can be configured to be coupled to the second rear portions 216 of the rear portion 204 and the front portion 206. The top portion 208 can be configured to be positioned opposite of the base portion 207 and can also be configured to be coupled to the first rear portion 215 of the rear portion 204 and the front portion 206. One or more of the portions 204 (including rear portions 215, 216), 206, 207, 208 can be straight, curved, slanted (as shown, for example, in FIG. 2A), bent, etc. Further, the portions 204 (including one or more of the rear portions 215, 216) and 206 can be configured to be disposed substantially perpendicular to the portions 207, 208. Alternatively, one or more of the portions 204, 206 (including one or more of the rear portions 215, 216) can be disposed at any angle with respect to one or more of the portions 207, 208 in any plane (i.e., x-y-z coordinate system).

In some implementations, the portions 204, 206, 207, 208 can be configured to form an integral rigid structure. Such integral structure can allow for additional rigidity as well as stackability of the apparatus 200, as for example is shown in FIGS. 3A-3C and 4A-4C.

In some implementations, the support members 205 can include cover members 210, 211, and 212. The cover member 210 can be configured to be coupled to the top portion 208, whereby a user of the apparatus 200 can be configured to place user's arms on top of the cover members 210 during use (e.g., while sitting on a chair around which the apparatus 200 is placed). The cover member 210 can include a cushion and/or a padding that can provide comfort to the user during use (e.g., the user can use the top portion 208 with cover member 210 as an armrest). Further, the cover member 210 can be manufactured from a slip-resistant material (e.g., leather, cloth, plastic, vinyl, etc.) that can prevent slippage of the user's arms during use (e.g., while sitting, standing up, etc.).

The cover members 211 and 212 can be configured to be coupled to the base portion 207 and can be configured to contact a surface on which the apparatus 200 is placed. The cover members 211, 212 can be also manufactured from slip-resistant materials (e.g., rubber, plastic, etc.) that can provide stability and slip-resistance to the apparatus 200 while in use. The cover members 210-212 can be attached to the respective portions 207, 208 using any mechanisms (e.g., glue, welding, bolt(s), screw(s), VELCRO®, etc.). Alternatively, the members 210-212 can be integral with the respective portions 207, 208 (e.g., base portion 207 can be manufactured with appropriate slip-resistant portions, etc.). In some implementations, the cover members 211, 212 can be used to protect the base portion 207 from damage (e.g., scratching, dents, etc.) whether during use and/or storage. In some implementations, a single and/or multiple cover portions covering the base portion 207 can be used. For example, the single cover portion can be configured to be disposed along the bottom of the base portion 207 from one end of the base portion 207 to the other end of the base portion 207. Further, the cover members 211, 212 can be configured to provide a balance to the apparatus 200 during use.

In some implementations, as stated above, the connecting members 202*a* and 202*b* can be configured to be coupled to the support portions 205, thereby providing a connection between the portions 205. The connecting member 202*a* can be configured to be substantially perpendicularly disposed with regard to the rear portions 215 and the connecting member 202*b* can be configured to be substantially perpendicularly disposed with regard to the rear portions 216, whereby the front portions 206 as well as the rear portions 204 are configured to be equidistant from each other. Alternatively, the connecting members 202 can be configured to be coupled to the rear portions 215, 216 at an angle, as for example is shown in FIGS. 2C-2D, whereby the distance between the front portions 206 is greater than the distance between the rear portions 204, or as shown in FIGS. 4A-4C, whereby the distance between the top portions 208 is less than the distance between the base portions 207 (which can allow for stacking of one or more apparatuses 200).

In some implementations, the support members 205 and/or the connecting members 202 can manufactured using tubes, bars, rods, poles, sticks, etc., and/or any combination thereof (hereinafter, "bars"). The bars (or one or more portions thereof) can have circular, square, rectangular, triangular, polygonal, and/or other desired cross-section. The bars (or one or more portions thereof) can be hollow, solid, partially hollow, partially solid, and/or any combination thereof. In some implementations, the bars (or one or more portions thereof) can be manufactured from aluminum, metal, steel, wood, fiberglass, plastic, alloys, composite materials, and/or any other materials, and/or any combination thereof. By way of a non-limiting example, using aluminum for the bars (or one or more portions thereof) can be advantageous for manufacturing, as aluminum can be highly malleable and elastic, and thus, is easy to bend and allows a deeper or more intricate metal-spinning; using steel for the bars (or one or more portions thereof) can be advantageous as steel can be tough, resilient, etc.

In some implementations, during use, the apparatus 200 (in the state shown in FIG. 2A) can be positioned around an object, such as a chair (e.g., an armless and/or inadequately armed/arm-rested chair, etc.) with the connecting members 202 being positioned behind and/or substantially adjacent the back of the chair and the support members 205 being placed adjacent each side of the chair. This can provide the user of the apparatus 200 with an ability to use top portions 208 of the support members 205 as armrests, such as while sitting in the chair (i.e., the user can choose to rest arms on the top portions 208 (or cover members 210, if the apparatus 200 is so equipped)), and/or as support, such when sitting down and/or getting up from the chair (e.g., the user can choose to place hands on the top portions 208 (or cover members 210, if so equipped) and prop him/herself when sitting down/getting up). While the user is using the apparatus 200, the cover members 211, 212 can be configured to provide stability and/or anti-slippage to the apparatus 200 by preventing movement (e.g., slipping, wobbling, etc.) of the apparatus 200 on the surface (e.g., floor) on which the apparatus 200 is being positioned.

FIG. 2B is a rear view of the apparatus 200 showing the cover members 212 covering parts of the rear portions 204 as well as the base portions 207 (as shown in FIG. 2A). The cover members 211 can be configured to cover parts of the front portions 206 as well as the base portions 207. The connections 209 can connect the first rear portions 215 (as shown in FIG. 2A) to the connecting member 202*a* and the connections 219 can connect the second rear portions 216 to the connecting member 202*b*. As shown in FIGS. 2A-2B, the first and second rear portions 215, 216 are connected to each other, thereby forming a gap 250 between the connecting members 202 (*a, b*).

In some implementations, the apparatus 200 can have a first dimension D2 corresponding to a distance between centers of the second rear portions 216, and a second dimension D3 corresponding to a distance between outer edges of the front portions 206. In some exemplary, non-limiting implementations, the dimensions D2, D3 can be in the range of approximately 20 inches to approximately 30 inches. In further exemplary, non-limiting implementations, the dimensions D2, D3 can be in the range of approximately 21-29 inches. In yet further, exemplary non-limiting implementations, the dimension D2 can be approximately 22 inches and dimension D3 can be approximately 28 inches. In alternate exemplary non-limiting, implementations, the dimension D2 and the dimension D3 can have any other value as long as the ratio of first dimension/second dimension (i.e., D2/D3) remain equal to and/or substantially equal to (e.g., within −0.25 and +0.25 of) 22/28. In yet other exemplary, non-limiting implementations, the dimension D2 and the dimension D3 can have any other values with the ratio of first dimension/second dimension (i.e., D2/D3) having any other value.

FIG. 2C illustrates the top view of the apparatus 200, where the front portions 206 of the apparatus 200 are configured to be further apart than the rear portions 204. As stated above, this can allow for stackability of the apparatus 200, as for example, is shown in FIGS. 4A-4C.

FIG. 2D illustrates a side view of the apparatus 200. In some implementations, the height H2 of the support member 205 can be varied by adjusting the height of the cover member 210. For example, the cover member 210 can be pulled in an upward direction away from the top portion 208 (e.g., using one or more sliding rods that may be coupled to the bottom of the cover member 210 and the top of the top portion 208). Similarly, the height H2 of the support member 205 can be adjusted by adjusting the height of the cover members 211, 212. The variation in the height H2 can be useful when the apparatus 200 is used with armless furniture of varying heights.

In some exemplary, non-limiting implementations, the height H2 can correspond to the distance between a top of the cover member 210 to the bottom of the cover members 211, 212. If the apparatus 200 is used to accommodate an object that is used by the user for sitting purposes (e.g., a chair in a restaurant, etc.), height H2 can be in the range of approximately 25 inches to approximately 30 inches. In some exemplary, non-limiting implementations, the height can be in the range of approximately 26 inches to approximately 28 inches. By way of a further non-limiting example, the height H2 can be 27.4 inches. In non-limiting example of the chair, the dimension H2 can also depend on the height of a seat portion of the chair with which the apparatus 200 is being used. Alternatively, any other value of height H2 can be used.

The apparatus 200 can have a length L2 (i.e., a distance between an outer edge of the rear portion 204 and an outer edge of the front portion 206). In some exemplary, non-limiting implementations, the length L2 can be in the range of approximately 14 inches to 25 inches. In further exemplary, non-limiting implementations, the length L2 can be in the range of approximately 19 inches to approximately 22 inches (e.g., for an adult chair). By way of a further non-limiting example, the length L2 can be 20.2 inches. In some exemplary, non-limiting implementations, the height H2 and the length L2 can have any other values. The dimensions for height H2 and length L2 can depend on the dimensions of the armless furniture with which the apparatus 200 is being used.

In some exemplary, non-limiting implementations, the height H2 and the length L2 can have any other value as long as the ratio of height/length (i.e., H2/L2) remaining equal to or substantially equal to (e.g., within −0.25 and +0.25 of) 27.4/20.2. In other exemplary, non-limiting implementations, the height H2 and length L2 can have any other values with the ratio of height/length (i.e., H2/L2) having any other values. The dimensions for the height H2 and the length L2 can depend on the height of a seat portion and the length of the armless furniture with which the apparatus 200 is being used.

Figure 2E:
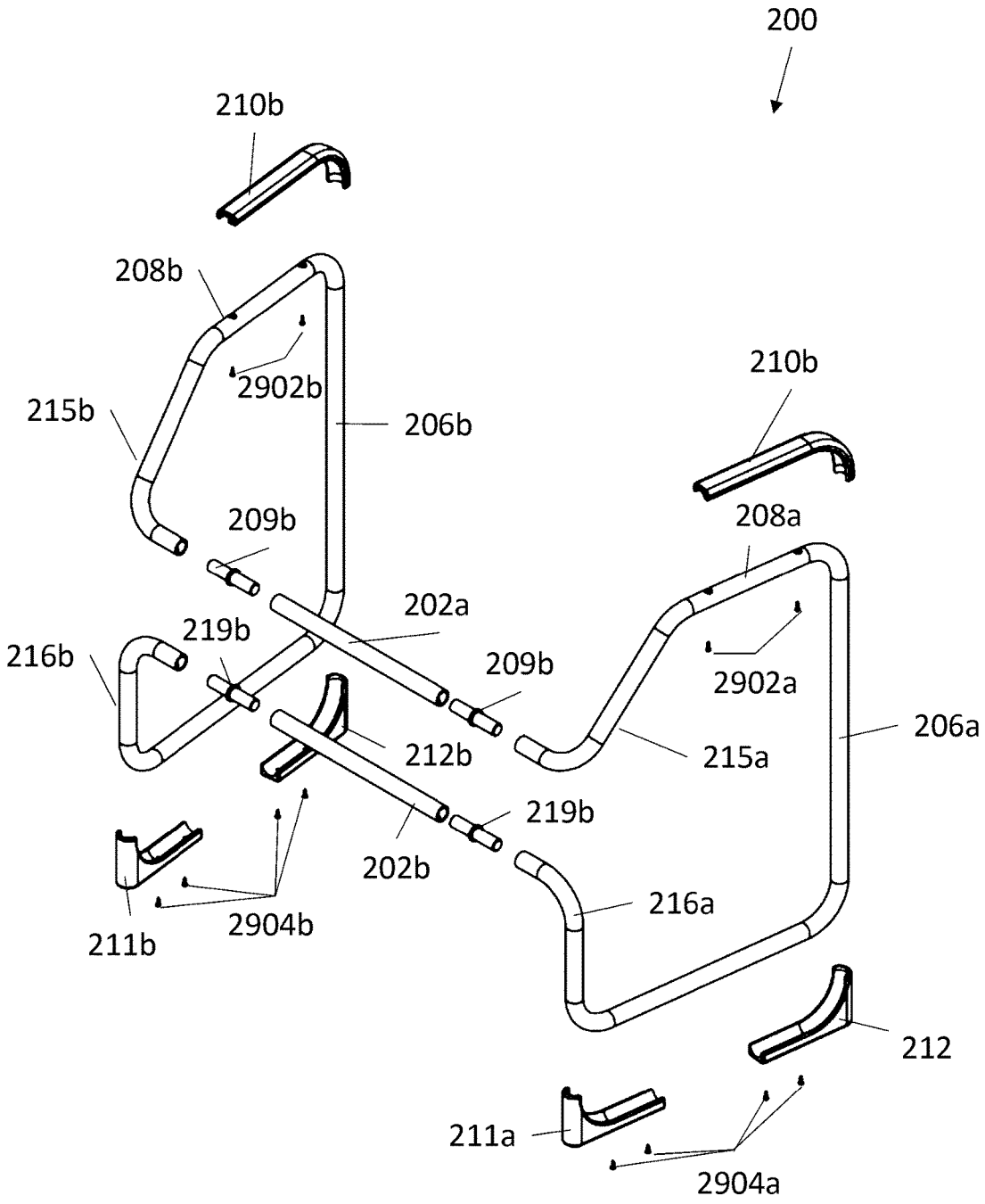

FIG. 2E illustrates an exploded view of various components of the apparatus 200. The connecting members 202 can be configured to be coupled to the connections 209 and 219 to form an integral rigid structure. These attachment mechanisms can include at least one of the following: welding, screwing, gluing, stitching, friction-fitting, interlocking, and/or any other attachment mechanisms, and/or any combination thereof. Alternatively, the connecting members 202 and the connections 209, 219 can be so molded during manufacture as to form a single integral structure.

In some implementations, the connections 209 and 219 can have cross-sectional diameters that are smaller than the interior diameters of the rear portions 215, 216 and the connecting members 202 (*a, b*). This can allow for placement of the connections 209, 219 inside the rear portions 215, 216 and the connecting members 202, as shown in FIG. 2E.

The cover members 210 can be attached to the top portions 208 using screws 2902 (*a, b*). While screws can be used for attaching the cover members 210 to the top portions 208, in alternate implementations, any other attachment mechanisms can be used, including, but not limited, welding, gluing, stitching, any other attachment mechanisms, and/or any combinations thereof. The cover members 211 and 212 can be attached to the base portions 207 using screws 2904 (*a, b*). While screws can be used for attaching the cover members 211, 212 to the base portions 207, in alternate implementations, any other attachment mechanisms can be used, including, but not limited, welding, gluing, stitching, any other attachment mechanisms, and/or any combinations thereof.

As can be understood, components of the apparatus 200 can be manufactured, packaged, and/or shipped separately, in disassembled form, in assembled form, and/or in any other fashion. A user of the apparatus 200 can be provided with appropriate instruction for assembly of the apparatus 200.

Figure 3A:
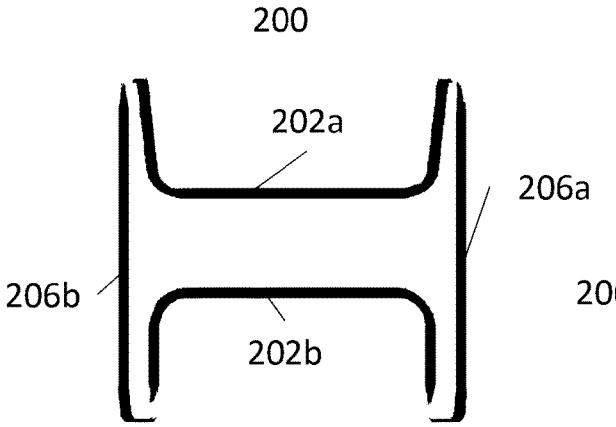
FIGS. 3A-3C illustrate various views of exemplary nesting portable frame support apparatus, according to some implementations of the current subject matter.
Figure 3B:
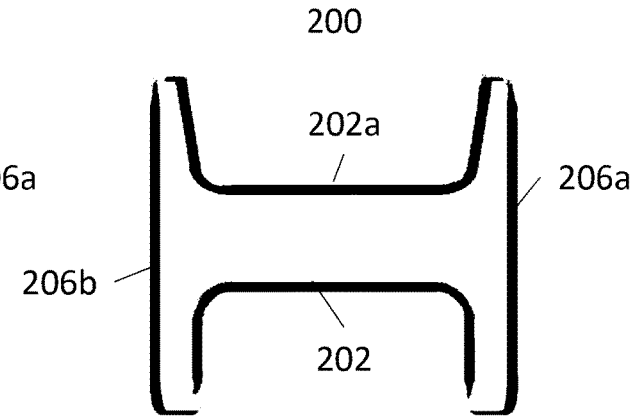
Figure 3C:
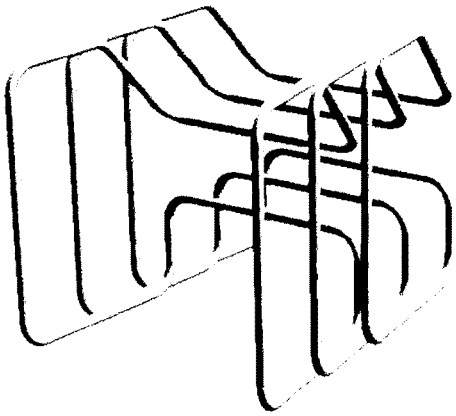

FIGS. 3A-3C illustrate rear views of various exemplary nesting configurations of the non-foldable apparatus 200, according to some implementations of the current subject matter. FIG. 3A illustrates a configuration of the apparatus 200 where a distance between the front portions 206 can be configured to be less than a distance between the front portions 206 of the apparatus 200 shown in FIG. 3B. In that regard, as shown in FIG. 3A, the plane of each support member 205 is configured to form a 7° angle with a plane that is perpendicular to the plane of the connecting members 202 of the apparatus 200. Such angular disposition can allow for the front portions 206 to have a greater distance than the distance between the rear portions 204 of the apparatus 200, thereby allowing stacking and/or nesting of multiple apparatus 200 either behind or in front of each other, as shown in FIG. 3C.

In FIG. 3B, the plane of each support member 205 is configured to form a 10° angle with a plane that is perpendicular to the plane of the connecting members 202 of the apparatus 200. Such angular disposition can allow for the front portions 206 to have a greater distance than the distance between the rear portions 204 of the apparatus 200 as well as a greater distance than the distance between front portions 206 of the apparatus 200 shown in FIG. 3A. Similar to the implementation shown in FIG. 3A, such angular disposition can allow stacking and/or nesting of multiple apparatus 200 either behind or in front of each other, as shown in FIG. 3C.

FIGS. 4A-4C illustrate rear views of various exemplary nesting configurations of the non-foldable apparatus 200, according to some, non-limiting implementations of the current subject matter. FIG. 4A illustrates a configuration of the apparatus 200 where a distance between the top portions 208 can be configured to be less than a distance between the top portions 208 of the apparatus 200 shown in FIG. 4B. In that regard, as shown in FIG. 4A, the plane of each support member 205 is configured to form a 7° angle with a plane that is perpendicular to the plane of the base portions 207 of the apparatus 200. Such angular disposition can allow for the top portions 208 to have a lesser distance than the distance between the base portions 207 of the apparatus 200, thereby allowing stacking and/or nesting of multiple apparatus 200 either on top or bottom of each other, as shown in FIG. 4C.

In FIG. 4B, the plane of each support member 205 is configured to form a 10° angle with a plane that is perpendicular to the plane of the base portion 207 of the apparatus 200. Such angular disposition can allow for the top portions 208 to have a lesser distance than the distance between the base portions 208 of the apparatus 200 as well as a greater distance than the distance between top portions 207 of the apparatus 200 shown in FIG. 4A. Similar to the implementation shown in FIG. 4A, such angular disposition can allow stacking and/or nesting of multiple apparatus 200 either on top or bottom of each other, as shown in FIG. 4C.

FIG. 5A illustrates a cross-sectional view of a portion of the apparatus 100 shown in FIGS. 1A-1I. In particular, FIG. 5A illustrates an exemplary connection assembly 520 that can be configured to couple of portions 114 and 116 with the rear portion 104 and to rotate the portions 114 and 116 with respect to the rear portion 104. For ease of description, designations "a" and "b" of the references numbers shown in FIGS. 1A-1I have been omitted, however, it should be noted that similar-numbered components shown in FIG. 5A correspond to the similar-numbered components shown in FIGS. 1A-1I.

Figure 5B:
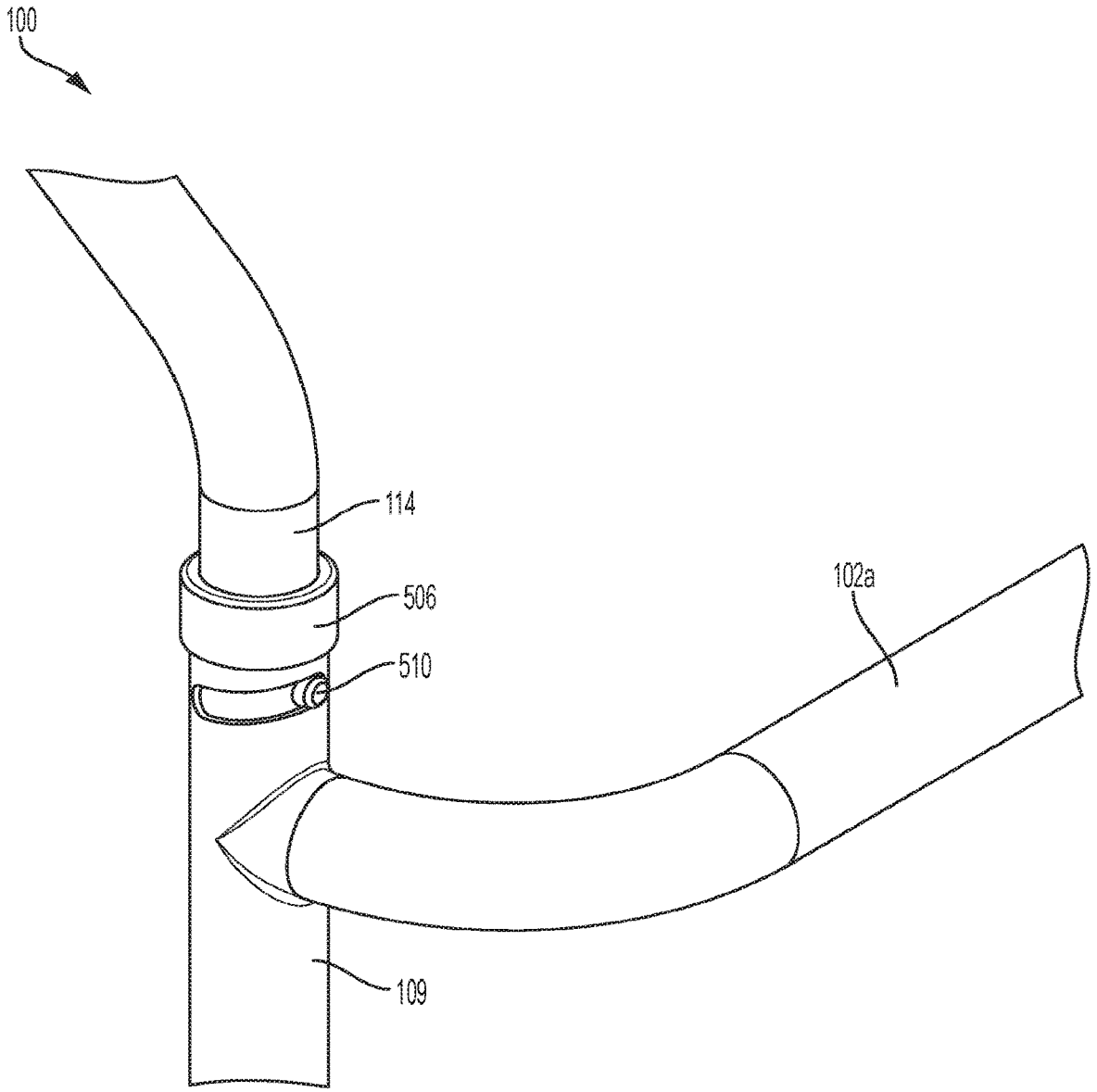

Referring to FIGS. 1I and 5A-B, the connection assembly 520 can include the inner bushings 502 and 504, the outer pivot bushings 506 and 508, and the spring pins 510 and 512. The portions 114 and 116 can be configured to be coupled to the rear portion 104 using the connection assembly 520 as shown in FIG. 1I.

As is further shown in FIG. 5A, the connection 109 can be configured to be coupled to curved portions 524 and 528 of the connection members 102*a*, 102*b*, respectively. The curved portions 524, 528 can be configured to provide a "deeper" positioning of the apparatus 100 around an object (e.g., a chair).

FIGS. 6A-D illustrates an exemplary portable support frame apparatus 600, according to some implementations of the current subject matter. The apparatus 600 can be used with armless or inadequately armed furniture, such as an armless or inadequately armed chair, an armless or inadequately armed couch, an armless or inadequately armed bed, and the like. Inadequately armed furniture can refer to furniture that has at least one of: short arms, inconveniently placed arms (for example, arms that are low in height), arms of inadequate strength, and the like. The apparatus 600 can be portable, and/or can easily and/or temporarily modify the armless and/or inadequately armed furniture without using much space and while still satisfying aesthetic considerations.

The apparatus 600 can include one or more bars 604 to which one or more armrests 602 can be coupled. The armrests 602 can be supported by legs 606. Each leg 606 can have a stopper 608 underneath. Each of the two ends of the bar 604 can include and/or be coupled to a support structure that can be used to support the apparatus 600. The support structure can be a disc 610, which can be made of denser or heavier material than the remaining portion of the bar 604 to ensure support. Although the support structure is shown to be a disc 610, in alternate implementations any other support mechanism can be used to ensure support. For example, the bar 604 can include or be attached to additional supports as discussed below with respect to FIGS. 6A-6D.

Each armrest 602 can be coupled to the bar 604 using an attachment mechanism. The attachment mechanism can include a pivot around which the armrest 602 can rotate so as to be foldable. With respect to the position shown in FIG. 6A, each armrest 602 can rotate in at least one of the following directions: an inward direction toward the other armrest 602, an outward direction away from the other armrest 602, an upward direction, and/or a downward direction. In some implementations, rotations in only one or more directions may be allowed to enhance ease of use and compactness while storing the apparatus 600. In some implementations, inward and/or outward rotations may be allowed as adjustments for comfort. The pivot can be attached to the bar 604 via a coupling mechanism, such as welding, screwing, gluing, stitching, any other attachment mechanisms, and/or any combinations thereof. In alternate implementations, some of these coupling mechanisms may prevent foldability of the armrests 602, which may be desirable.

The rotation of the armrest 602 around the pivot can be manual. In an alternate implementation, the bar 604 can include an electronic button, which when pressed can automate the rotation of the armrest 602 in any desired direction (that is, the desired direction among: the inward direction toward the other armrest 602, the outward direction away from the other armrest 602, the upward direction, and the downward direction). Although a pivot is described to enable the foldability of the armrest 602, in alternate implementations any other one or more structural components can be used to enable foldability.

Each leg 606 can be coupled to the corresponding armrest 602 via an attachment mechanism, such as such as welding, screwing, gluing, stitching, any other attachment mechanism, and/or any combination thereof. In some implementations, the legs 606 can be removed from the armrests 602 to attain the configuration shown in FIGS. 7A-7C. At least one of the armrests 602, the legs of the bar 604, and the legs 606 can be extended and/or reduced in length using an extension mechanism.

The armrest 602 can be made of wood, metal, plastic, alloy, any other materials, and/or any combinations thereof. The bar 604 can be made of wood, metal, plastic, alloy, any other materials, and/or any combinations thereof. Each leg 606 can be made of wood, metal, plastic, alloy, any other materials, and/or any combinations thereof. Each stopper 608 can be made of any wood, any metal, any plastic, any thermoplastic, any alloy, any other materials, and/or any combinations thereof. Each disc 610 can be made of any wood, any metal, any plastic, any thermoplastic, any alloy, any other materials, and/or any combinations thereof. Any of the armrests 602, bar 604, legs 606, stoppers 608, and discs 610 can be covered with cloth and/or any other material of any structure, type, color, etc. In some implementations, the cloth can be replaceable and/or removable.

Figure 11:
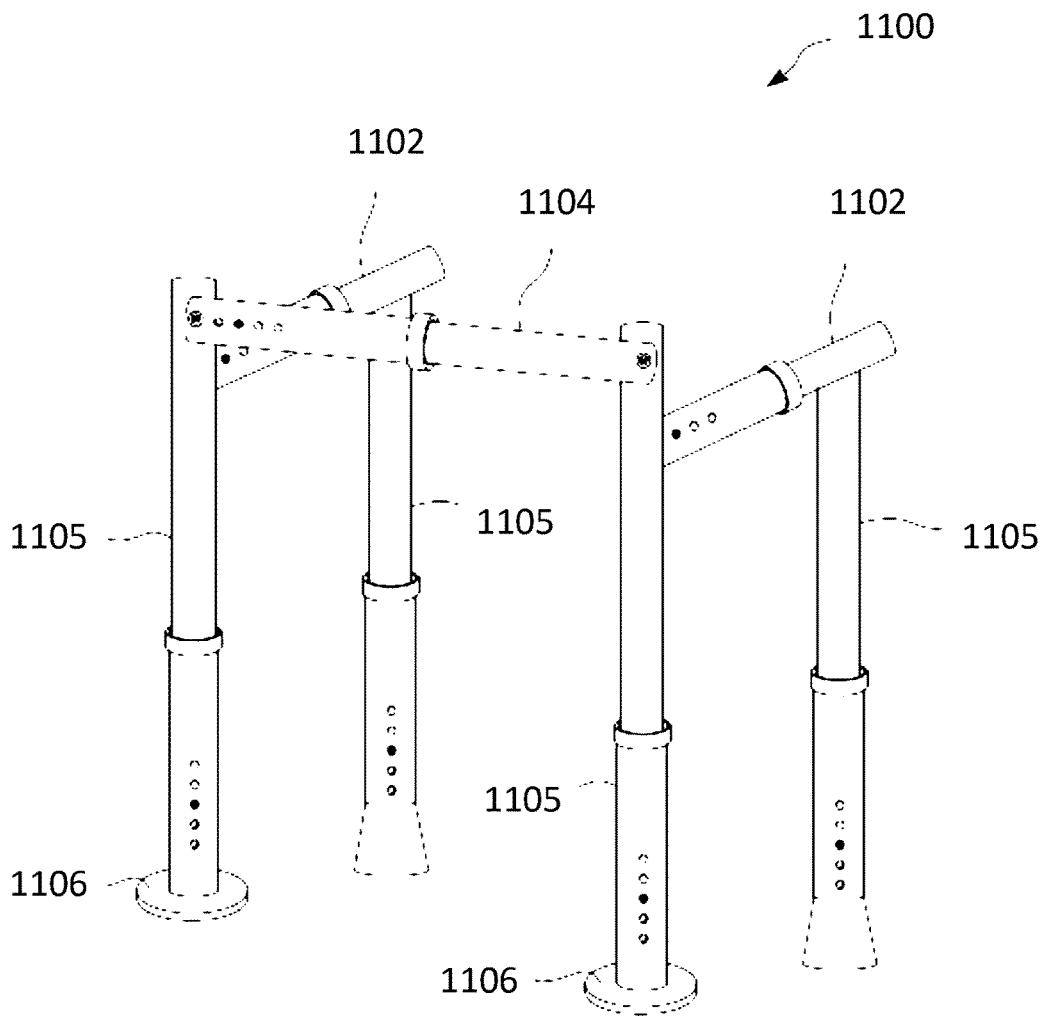
FIG. 11 illustrates yet another exemplary portable frame support apparatus, according to some implementations of the current subject matter.

The armrest 602 can have any shape, such as a rectangular, square, circular, triangular, polygonal, cylindrical, elliptical, any other shape, and/or any combinations thereof. While the bar 604 is shown as an inverted "U" shaped bar, any other variations in shape are possible. For example, in alternate implementations, the bar 604 can have a "Π" shape as shown in FIG. 11. In yet exemplary implementations, any other shape is possible, such as an "n" shape (which can include a small extension on the top left of the inverted "U" shaped bar 604), "π" (where the top bar in the frame of FIG. 11 is protruded along its length), and/or any other shape. In some implementations, each leg 606 can be cylindrical. In an alternate implementations, the cross-section perpendicular to the length of each leg 606 can have any other shape, such as a square, rectangle, triangle, polygon, ellipsis, and/or the like. The disc 610 can have any radius and/or height. The stopper 608 can have any height, weight or shape. The cross-section of the stopper 608 can be a rectangle, square, circle, triangle, polygon, ellipsis, any other shape, and/or any combinations thereof. In some implementations, the bar 604 can have another structural element instead of the circular disc 610. This structural element can have any height, and its cross-section perpendicular to the height can have any shape, such as a rectangle, square, circle, triangle, polygon, cylinder, ellipsis, any other shape, and/or any combinations thereof.

Figure 6A:
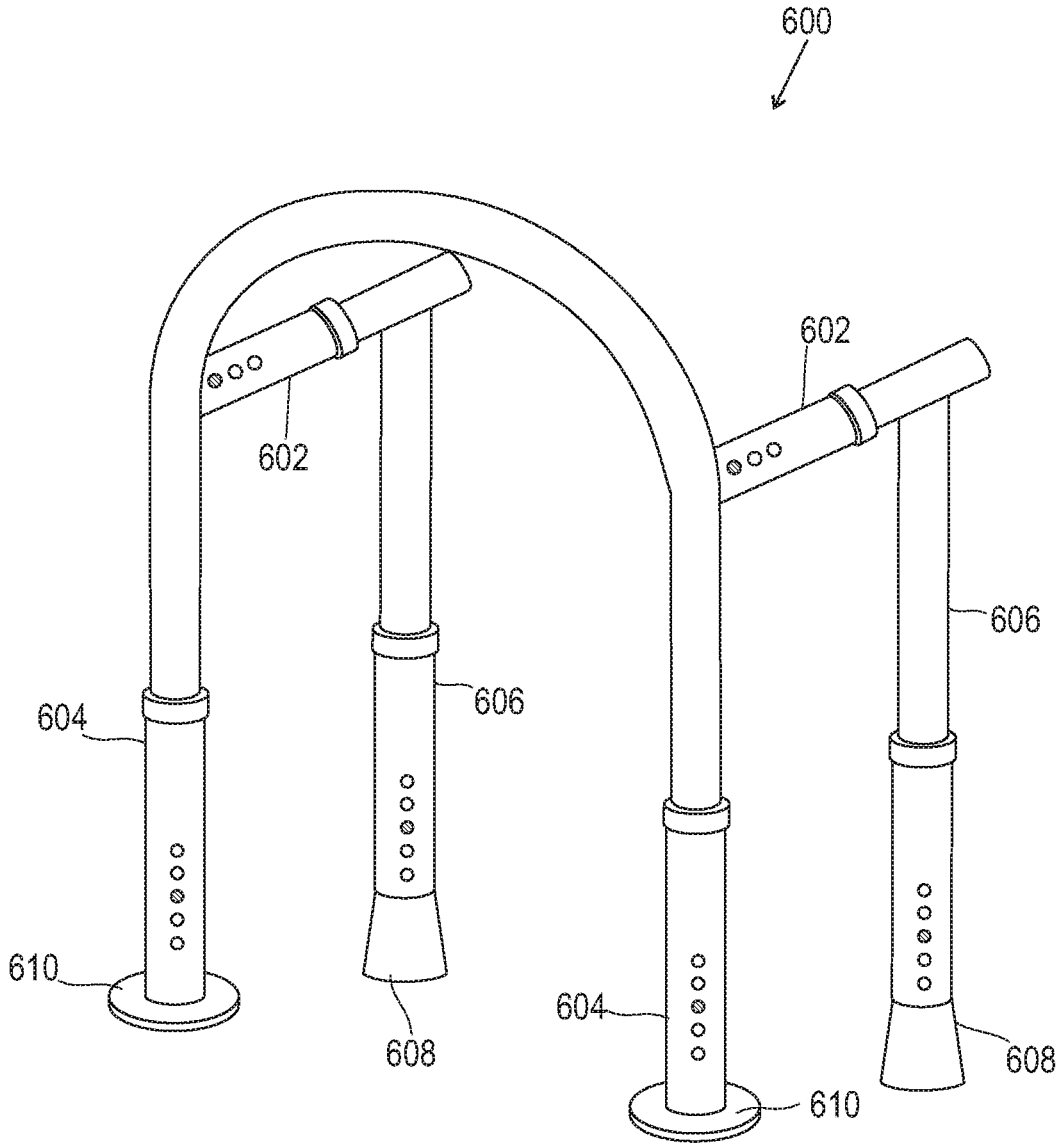
FIGS. 6A-6D illustrate various views of yet another exemplary portable frame support apparatus, according to some implementations of the current subject matter.
Figure 6B:
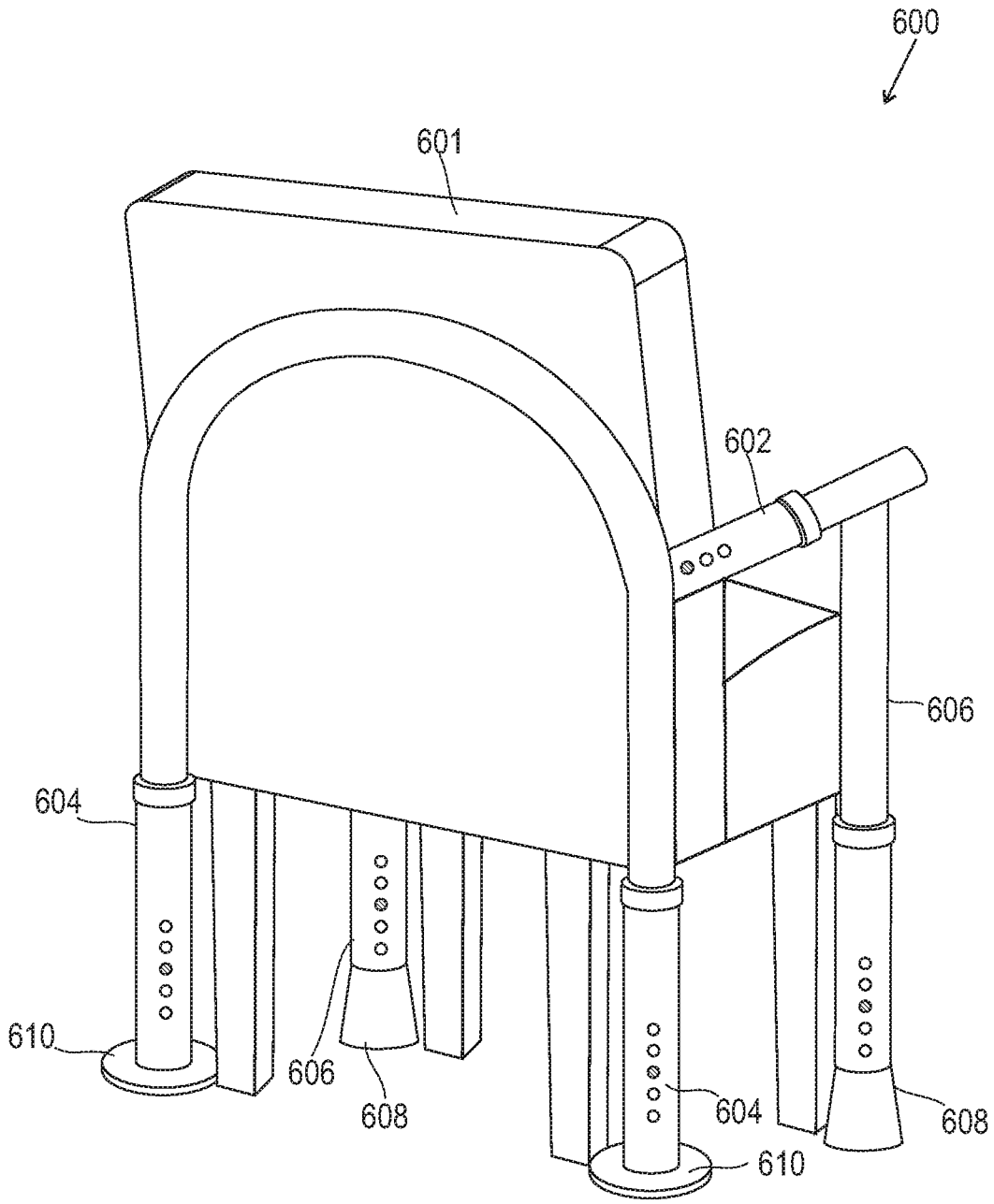
Figure 6C:
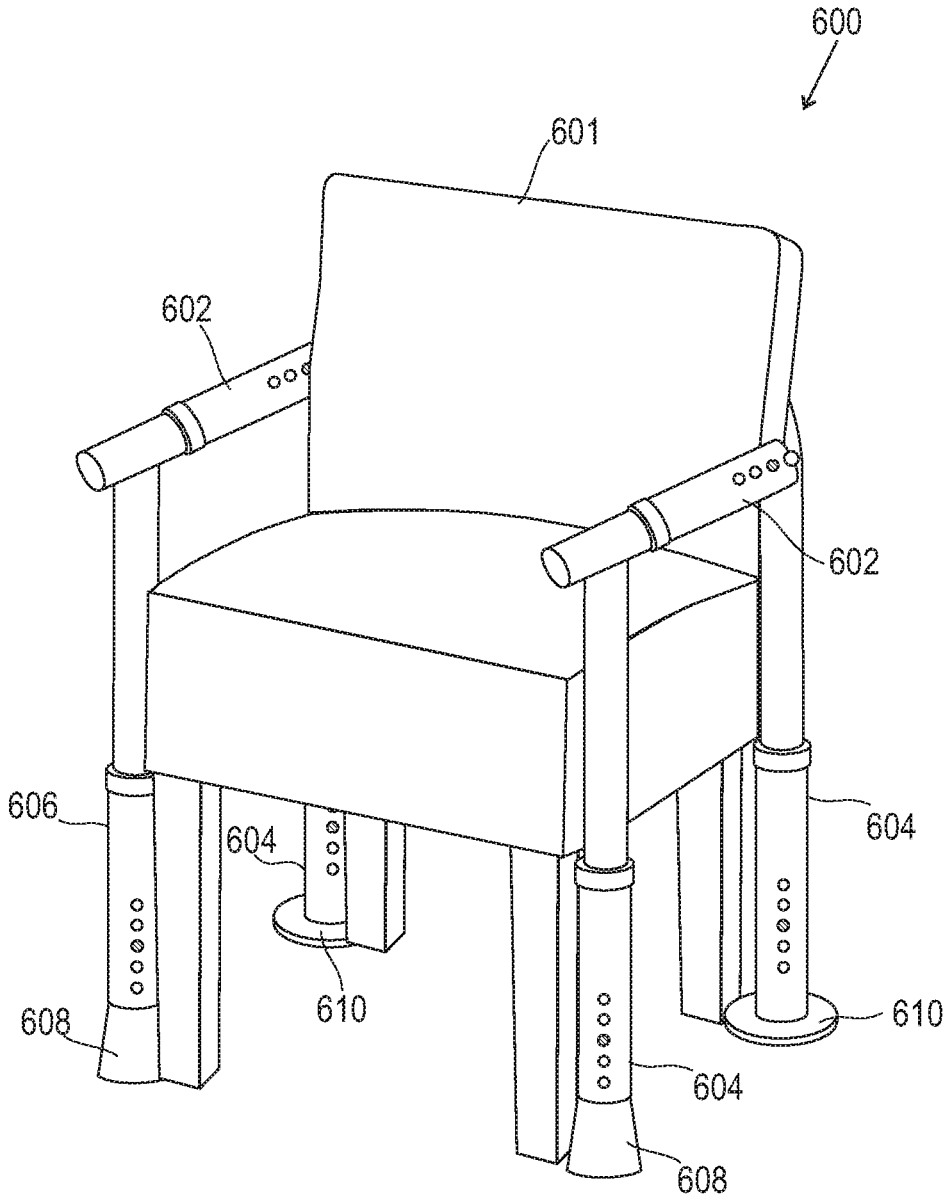
Figure 6D:
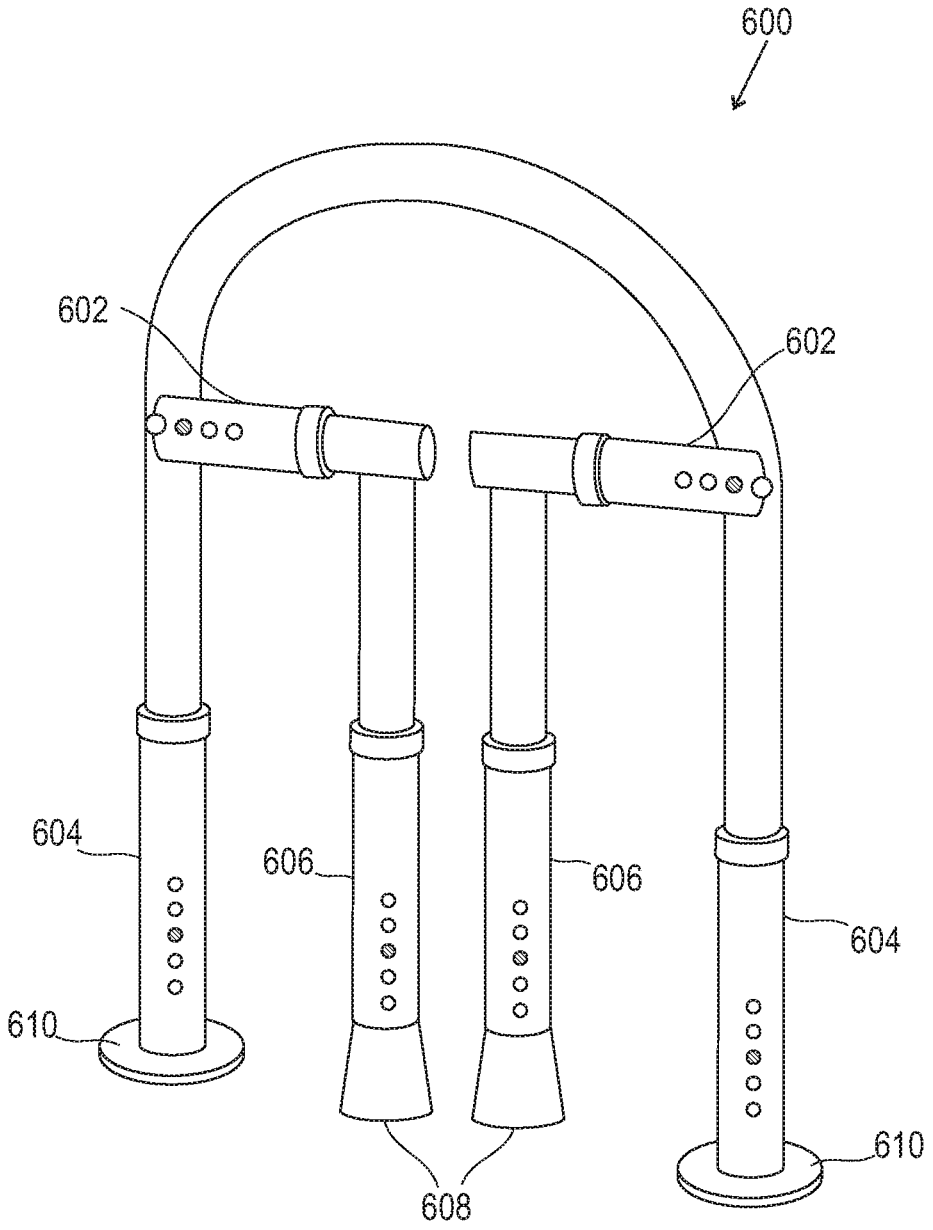

The apparatus 600 can be foldable (as shown in FIG. 6D) and can be portable, can consume very little space, and can be aesthetically pleasing, thereby encouraging use of such apparatuses by various establishments—such as restaurants, hotels, offices, homes, and the like—that use armless or inadequately armed furniture. The increased use of such apparatuses 600 can advantageously encourage persons in wheelchairs, persons who use walkers, and other handicapped, disabled, infirm, or elderly persons to visit, patronize, and enjoy establishments with armless or inadequately armed furniture such as those noted above. The apparatus 600 can be placed adjacent to (for example, behind, in front of, or surrounding) the armless or inadequately armed furniture. In alternate implementations, the apparatus 600 can be attached to and/or positioned next to an armless and/or inadequately armed furniture via any mechanism, such as clamping via one or more clamps, screwing via one or more screws, and/or the like, as shown in FIGS. 6B-6C.

In particular, FIG. 6B illustrates a rear perspective view of the use of the apparatus 600 being positioned adjacent to and around an armless chair 601. As can be seen, the armrests 602 are configured to protrude on each side of the chair 601, thereby providing an armrest support to the user. FIG. 6C illustrates a front perspective view of the use of the apparatus 600 positioned adjacent to and around chair 601.

FIG. 6D illustrates a perspective view of the apparatus 600 when the armrests 602 have been folded by rotating in the inward direction (i.e., toward each other). The folded configuration can advantageously allow easy storage of the apparatus 600 in compact storage locations.

Figure 7A:
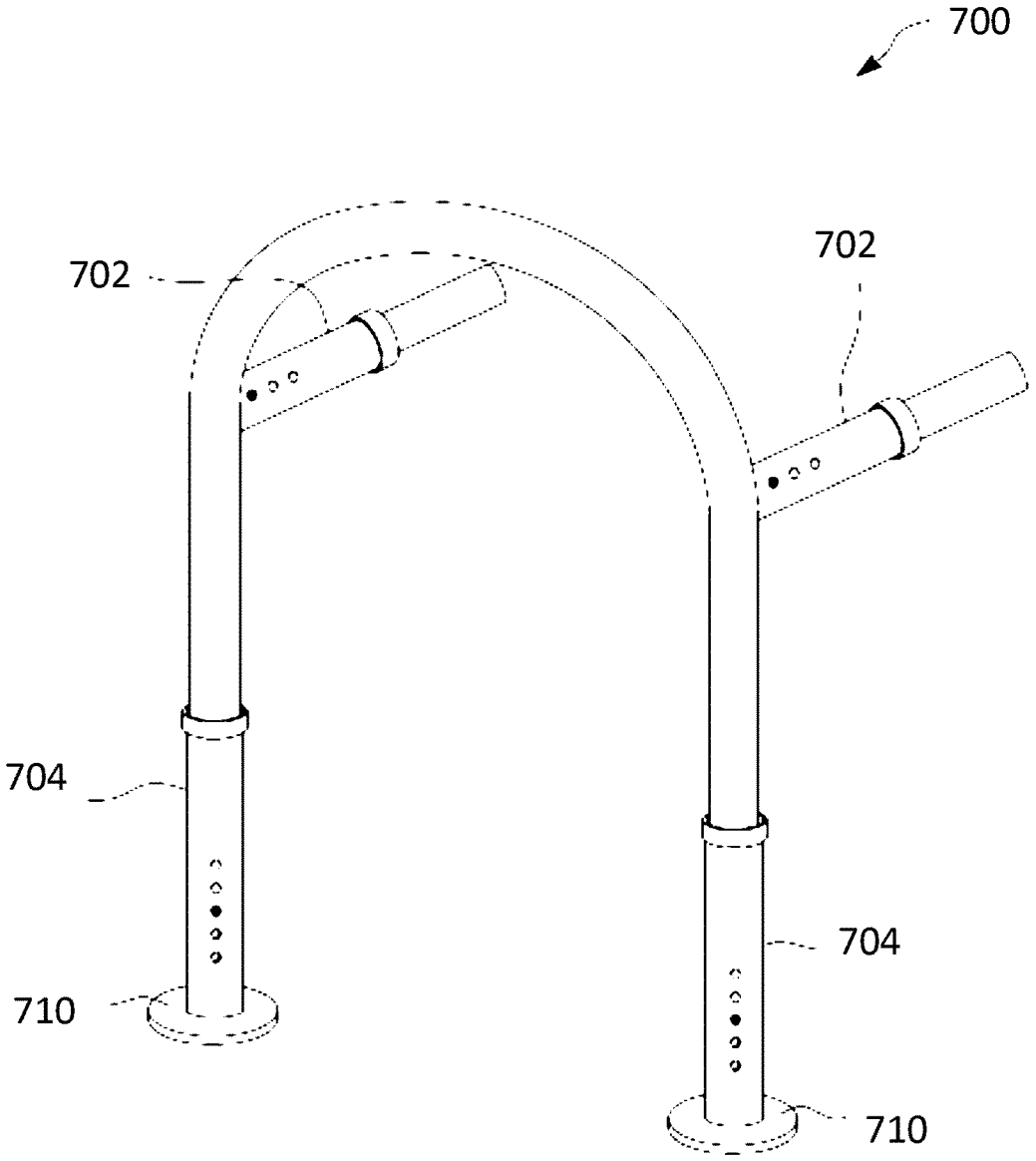
FIGS. 7A-7C illustrate various views of yet another exemplary portable frame support apparatus, according to some implementations of the current subject matter.
Figure 7B:
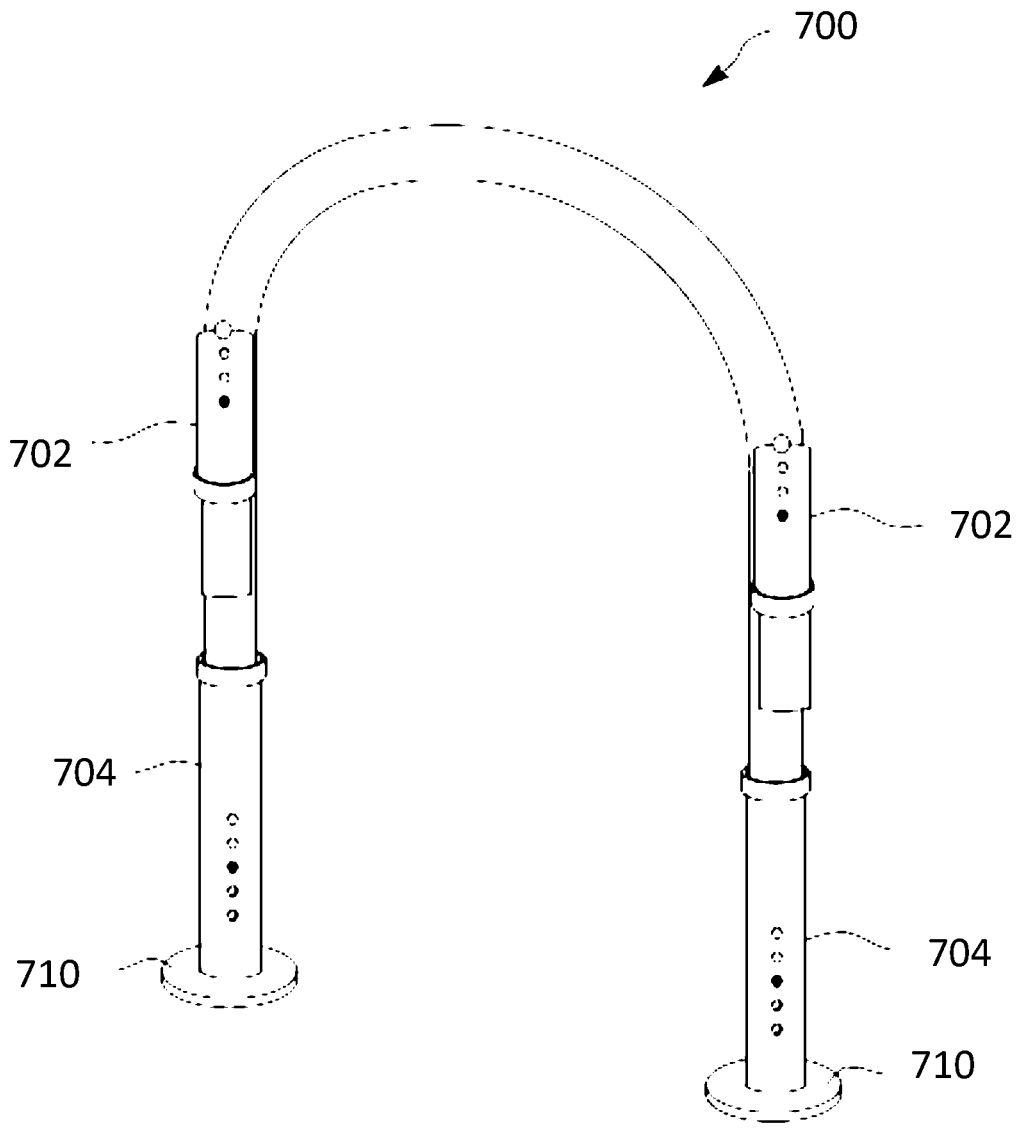
Figure 7C:
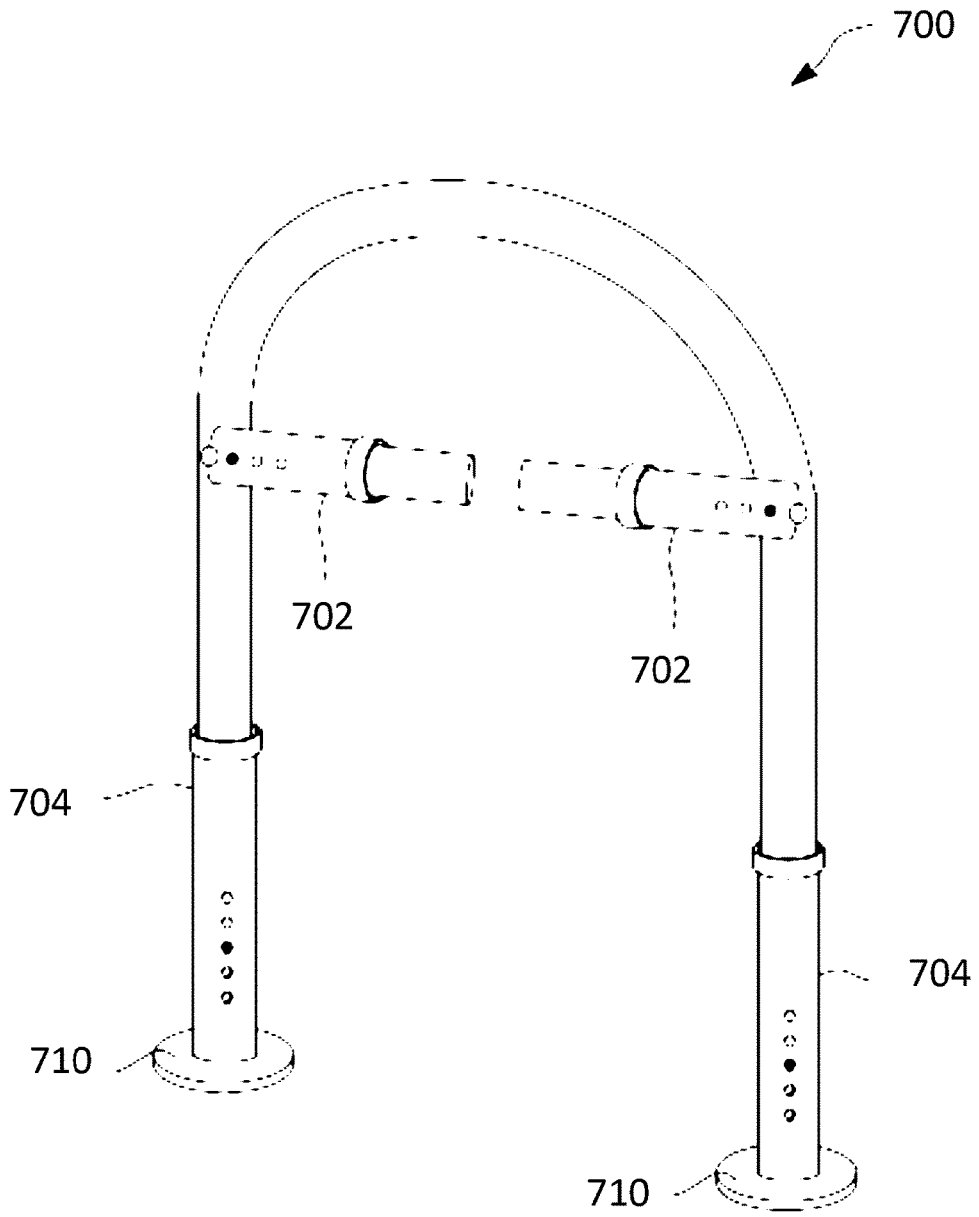

FIGS. 7A-7C illustrate a portable frame apparatus 700 without the front legs 606 (shown in FIG. 6A), according to some implementations of the current subject matter. In the apparatus 700, the discs 710 can be made substantially heavier than the remaining portion of the apparatus 700 so that the discs 710 along with the armless and/or inadequately armed furniture, to which the apparatus 700 can be coupled, can provide sufficient support so as to prevent slipping and/or falling of the apparatus 700 when the user sits on or stands up from the armless or inadequately armed furniture using the armrests 702. In some implementations, the legs 606 (shown in FIG. 6A) can be removable in the frame 600, and the frame 700 can be obtained by removing those legs.

In alternate implementations, each armrest 702 can be a cantilever beam attached to the bar 704. In some implementations, the armrests 702 can be attached to a bed-frame (not shown in FIG. 7A) of a bed, rather than to the bar 704.

FIG. 7B illustrates the apparatus 700 when the armrests 702 have been folded by rotating the armrests 702 in a downward direction. This folded configuration can advantageously allow an easy storage of the apparatus 700 in compact storage locations. FIG. 7C illustrates the apparatus 700 when the armrests 702 have been folded by rotating the armrests 702 in an inward direction. This folded configuration can also advantageously allow an easy storage of the apparatus 700 in compact storage locations.

Figure 8:
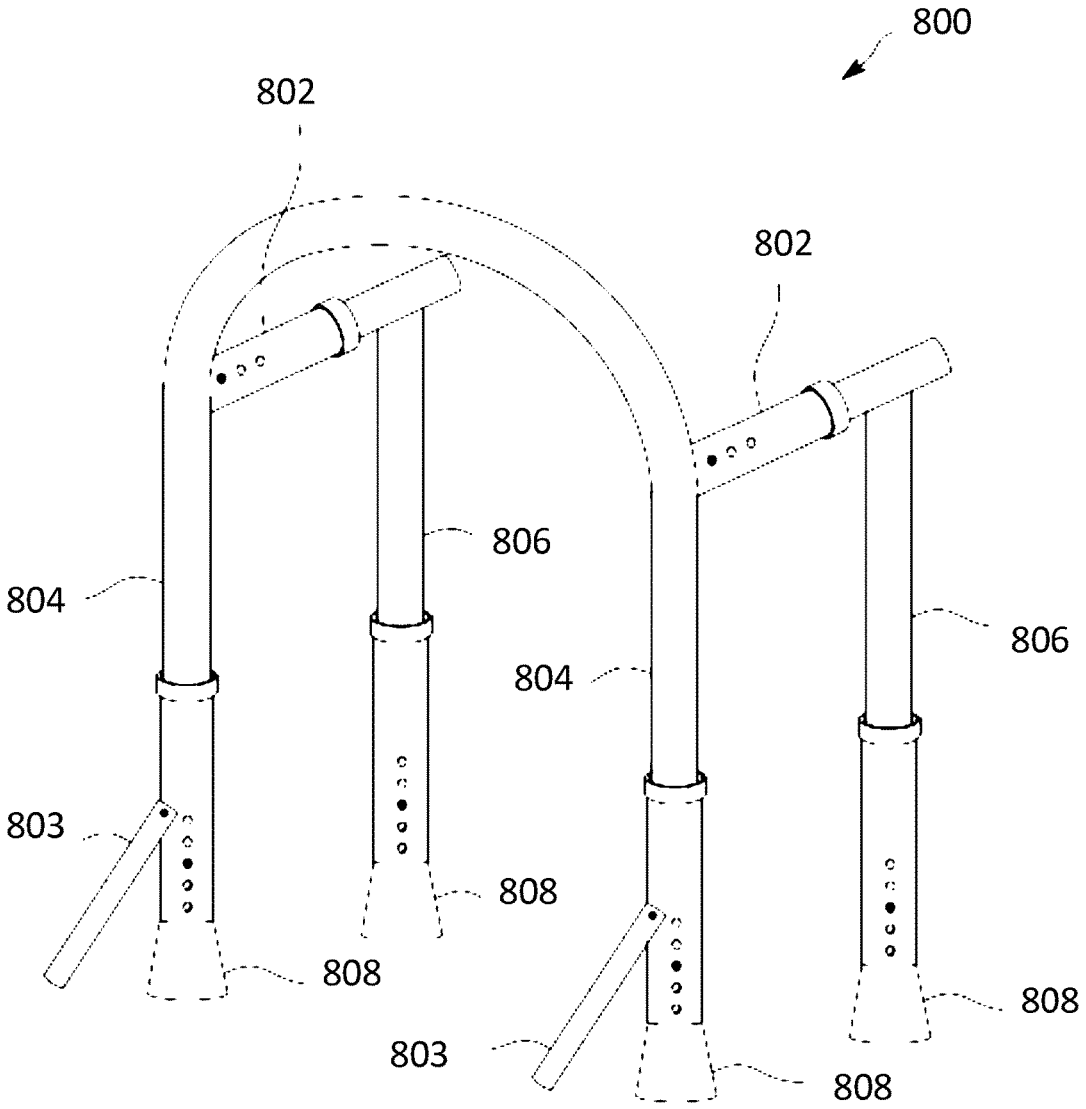
FIG. 8 illustrates another exemplary portable frame support apparatus, according to some implementations of the current subject matter.

FIG. 8 illustrates another exemplary portable frame apparatus 800 with armrests 802 where the apparatus 800 is supported using additional supports 803, according to some implementations of the current subject matter. Each additional support 802 can be made of wood, metal, plastic, alloy, any other materials, and/or any combinations thereof. Each additional support 803 can be cylindrical in structure. In alternate implementations, the additional support 803 can have different heights and can be placed at different angles with respect to the vertical portions of the bar 804. In alternate implementations, the cross-section of the additional support 803 in a direction perpendicular to its length can have any shape, such as rectangle, square, circle, triangle, polygon, ellipsis, any other shape, and/or any combinations thereof.

Each additional support 803 can be attached to the bar 804 via an attachment mechanism. The attachment mechanism can include a pivot around which the additional support 803 can rotate so as to be foldable. The pivot can be attached to the bar 804 via a coupling mechanism, such as welding, screwing, gluing, stitching, any other attachment mechanisms, and/or any combinations thereof. Note that in some implementations, some of these attachment mechanisms may prevent foldability of the additional supports 803, and such a prevention of the foldability may be desirable in those implementations. The rotation of the additional support 803 around the pivot can be manual. In an alternate implementation, the bar 804 can include an electronic button, which when pressed can automate the rotation of the additional support 803 around the pivot. Although a pivot is described to enable the foldability of the additional support 803, in alternate implementations any other one or more structural components can be used to enable foldability.

In alternate implementations, the armrests 802 and/or the front legs 806 can be configured to be coupled to a bed-frame (not shown in FIG. 8) of a bed, rather than to the bar 804.

Figure 9:
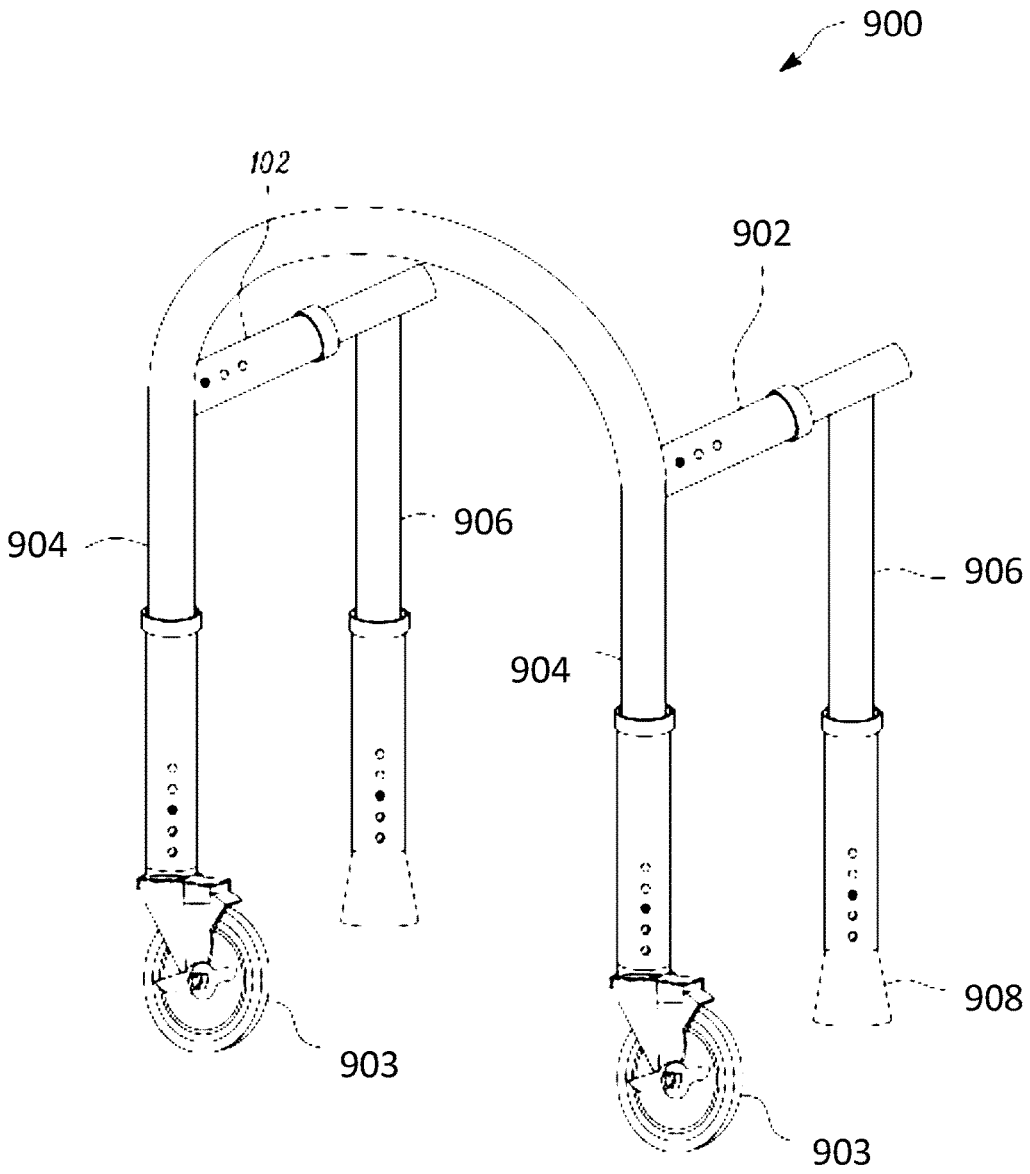
FIG. 9 illustrates yet another exemplary portable frame support apparatus, according to some implementations of the current subject matter.

FIG. 9 illustrates another exemplary portable frame apparatus 900 that uses lockable wheels 903 instead of discs 106, according to some implementations of the current subject matter. The wheels 903 can enhance the ease of movement of the frame 900, which can be particularly advantageous when the frame 900 is heavy. The wheels 903 can include a locking mechanism, which can be activated when the user places weight on any armrest 902. This locking mechanism can prevent the frame 900 from slipping—by preventing the wheels 903 from moving—when the user uses one or both of the armrests 902 for support while sitting on or standing up from the armless or inadequately armed furniture.

Figure 10:
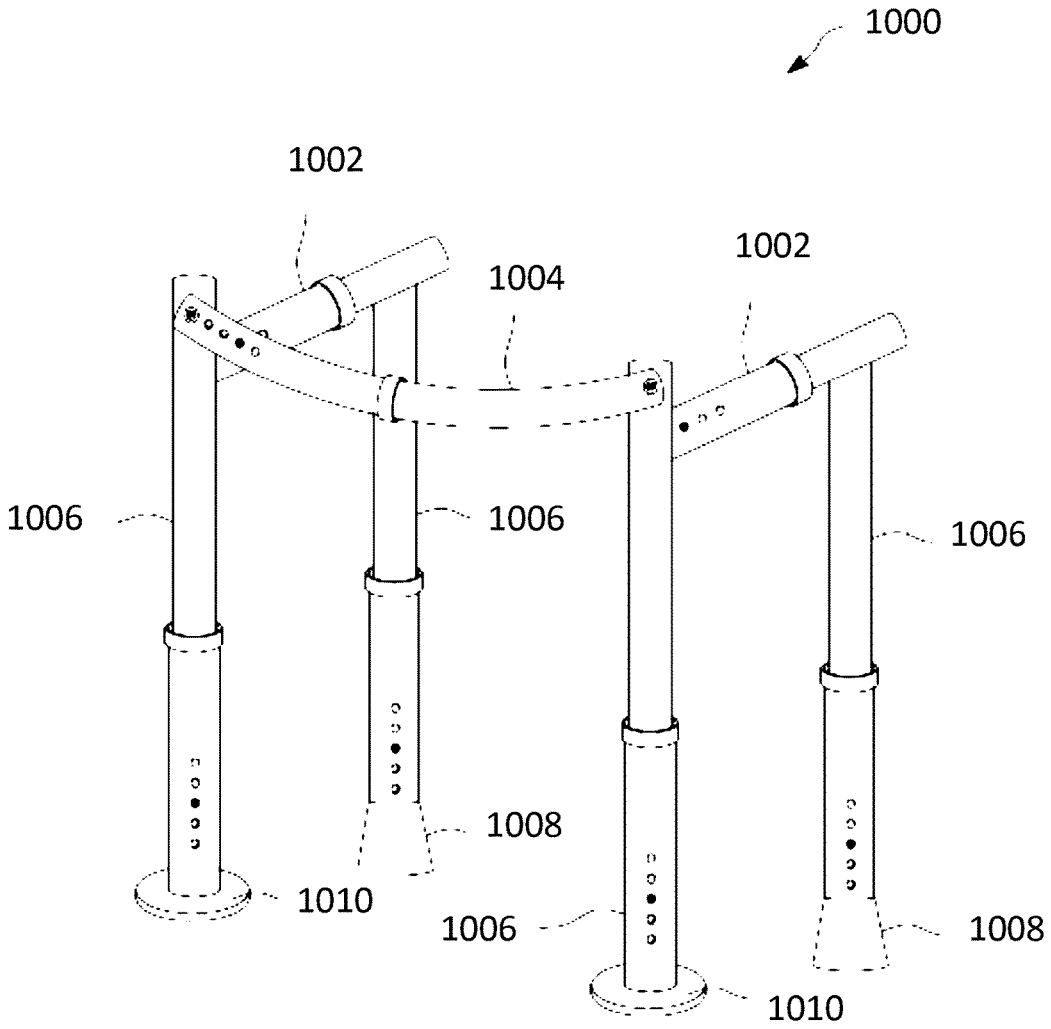
FIG. 10 illustrates yet another exemplary portable frame support apparatus, according to some implementations of the current subject matter.

FIG. 10 illustrates another exemplary portable frame apparatus 1000 configured to provide armrests 1002 for armless or inadequately armed furniture that has a curved back, according to some implementations of the current subject matter. The frame 1000 can include legs 1006 and a curved structural element 1004 attached to the legs 1006. Each of the legs 1006 and the structural element 1004 can be extended and/or reduced in length using an extension mechanism.

FIG. 11 illustrates another exemplary portable frame apparatus 1100 configured to provide armrests 1102 for armless or inadequately armed furniture that has a flat back, according to some implementations of the current subject matter. The frame 1100 can include legs 1105 and a straight structural element 1104 attached to the legs 1105. Each of the legs 1105 and the structural element 1104 can be extended or reduced in length using an extension mechanism.

In some implementations, the straight structural element 1104 can be flexible such that it can be curved to attain the curved structural element 1004 (shown in FIG. 10). In some implementations, the straight structural element 1104 can be flexed in any shape and/or direction so as to fit any armless or inadequately armed furniture.

In some implementations, the portable support frames described herein can be equipped with various additional mechanical, electronic and/or other desired features. One or more portions of the portable support frames can have any desired sizes, shapes, configurations, flexibility, rigidity, etc. to suit a particular need. Further, any desired materials can be used in manufacturing the portable support frames.

Figure 12:
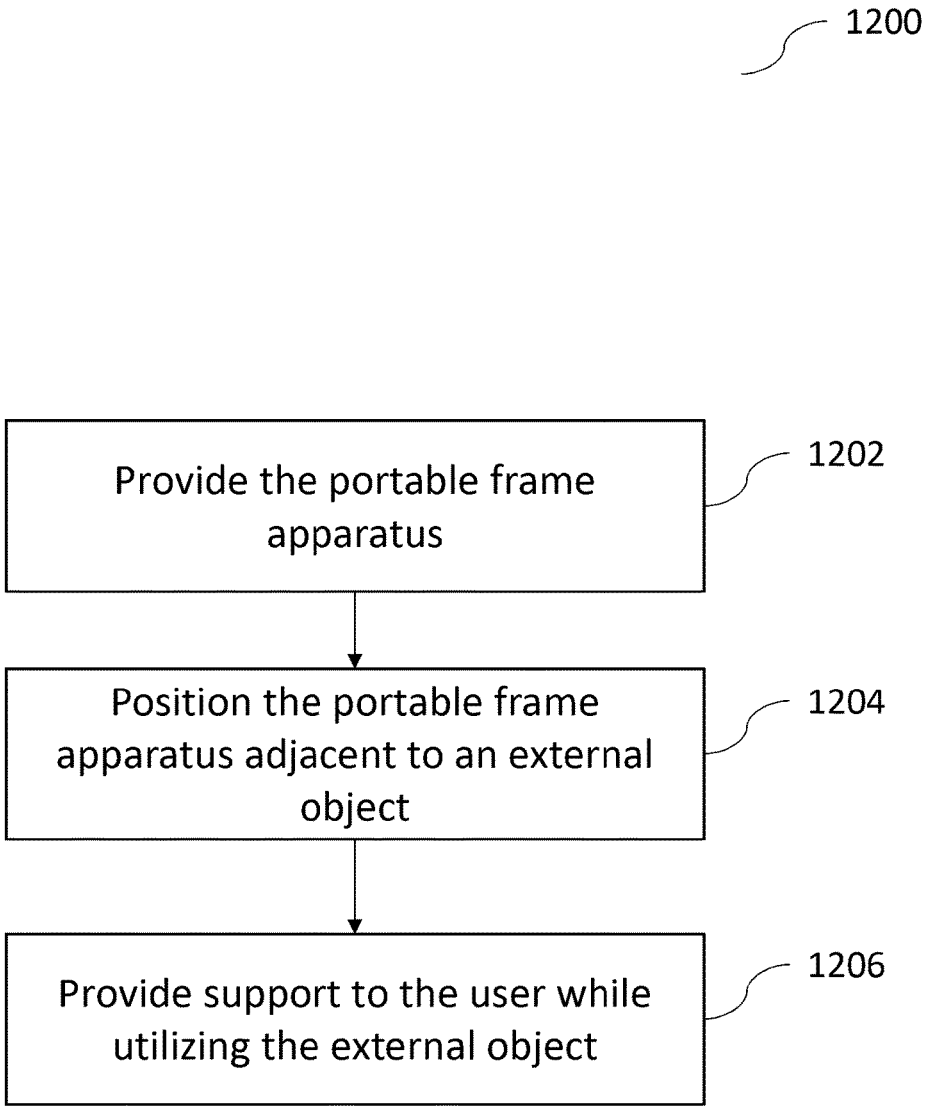
FIG. 12 illustrates an exemplary method, according to some implementations of the current subject matter.

FIG. 12 illustrates an exemplary method 1200 for using a portable frame apparatus described herein, according to some implementations of the current subject matter. At 1202, the portable frame apparatus described above can be provided. At 1204, the portable frame apparatus can be positioned adjacent to an external object utilized by a user. At 1206, support to the user can be provided using the portable frame apparatus, while the users utilizes the external object.

In some implementations, the portable frame apparatus (such as the one discussed above with regard to FIGS. 1A-11) can include a frame that can include a first support member and a second support member, and at least one connecting member. The connecting member can be configured to be coupled to the first support member at a first end of the connecting member and to the second support member at a second end of the connecting member. The first support member, the second support member and the connecting member can form a rigid structure that can provide support to a user of the portable frame apparatus.

In some implementations, the current subject matter can include one or more of the following optional features. In some implementations, the connecting member can be rigidly coupled to the first and second support members. In alternate implementations, the connecting member can be rotatably coupled to at least one of the first and second support members.

In some implementations, each support member can include a front portion, a rear portion, a top portion, and a base portion. The front portion can be configured to be coupled to the top and rear portions and the base portion can be configured to be coupled to the top and rear portions and disposed opposite the top portion. The connecting member can be configured to be coupled to the rear portions of the support members.

In some implementations, at least one of the front portion, the rear portion, the top portion, the base portion, and the connecting member can be configured to be expandable.

In some implementations, the user of the portable frame apparatus can be configured to contact at least one of the top portions of the support members during use of the portable frame apparatus.

In some implementations, the front, rear, top, and base portions of each support member can form an integral rigid structure. In alternate implementations, at least one of the front, rear, top, and base portions of one of the support members can include a pivoting joint configured to pivotally connect to another portion of the same support member.

In some implementations, the top portion can include a cover member configured to be coupled to the top portion. The cover member can be configured to provide at least one of the following: a comfort to the user using the portable frame apparatus, preventing slipping by the user during use of the portable frame apparatus, and/or any combination thereof.

In some implementations, the base portion can include a base cover member configured to be coupled to the base portion. The base cover member can be configured provide at least one of the following: increase stability of the portable frame apparatus during use, increase traction of the portable frame apparatus during use and any combinations thereof.

In some implementations, the base portion can includes at least one wheel rotatably coupled to the base portion, thereby providing mobility to the portable frame apparatus. Further, the base portion can include at least one braking member configured to apply braking to the at least one wheel to prevent movement of the portable frame apparatus.

In some implementations, the rear portion of each support member can include a first rear portion and a second rear portion. The first rear portions of the first and second support members can be configured to be coupled to a first connecting member. The second rear portions of the first and second support members can be configured to be coupled to a second connecting member. Further, the first and second connecting members can be configured to be separate from each other, thereby creating a gap between the first connecting member and the second connecting member.

In some implementations, a distance between the front portions of the support members can be greater than or equal to a distance between the rear portions of the support members. In alternate implementations, a distance between the top portions of the support members can be less than or equal to a distance between the base portions of the support members. In further alternate implementations, a distance between the front portions of the support members can be greater than or equal to a distance between the rear portions of the support members as well as a distance between the top portions of the support members can be less than or equal to a distance between the base portions of the support members.

In some implementations, the height of the portable frame apparatus is in the range of approximately 20 inches to approximately 30 inches. The width of the portable frame apparatus is in the range of approximately 14 inches to 30 inches. The length of the portable frame apparatus is in the range of approximately 14 inches to 25 inches.

In some implementations, at least a portion of the portable frame apparatus can be manufactured from at least one of the following: aluminum, metal, steel, wood, fiberglass, plastic, alloy, composite material, and/or any combinations thereof.

In some implementations, the portable frame apparatus can be configured to be placed adjacent to an object being used by the user thereby providing arm support to the user. In some implementations, the portable frame apparatus can be configured to provide support to the user while the user is performing at least one of the following: standing, sitting, lying down, exercising, crawling, and any combination thereof.

In some implementations, the portable frame apparatus can include another connecting member. The other connecting member can be separate from the connecting member and can be configured to be separately coupled to the first and second support members.

In some implementations, the portable frame apparatus can be configured to be stackable with at least another portable support apparatus.

In some implementations, at least one dimension of at least one of the first support member, the second support member, and the connecting member can be configured to be adjustable.

In some implementations, the current subject matter relates to a method of using a portable frame apparatus. The method can include providing the portable frame apparatus described above, positioning the portable frame apparatus adjacent to an external object utilized by a user, and providing, using the portable frame apparatus, support to the user while utilizing the external object.

Although a few variations have been described in detail above, other modifications can be possible. For example, the logic flows or sequences described herein do not require the particular order shown, or sequential order, to achieve desirable results. Further, the features described in different implementations are interchangeable and/or additive to create further implementations, which are also within the scope of this patent application. Other implementations may be within the scope of the following claims.

What is claimed:

1. A method for using a chair, said method comprising:

(a) unfolding a portable frame apparatus from a folded state to an unfolded state, wherein the portable frame apparatus comprises:

(i) two support members, wherein each support member has a front portion and a top portion, wherein within each support member the front portion extends from the top portion, the front portion forms a leg, and each leg extends to a floor; and (ii) a connecting member, wherein each top portion of each support member is rotatably coupled to the connecting member, wherein in the folded state each support member defines a folded angle relative to the connecting member and in the unfolded state each support member defines an unfolded angle relative to the connecting member, and wherein the unfolded angle of each support member is larger than the folded angle of each support member and when unfolding the portable frame apparatus each support member rotates outward away from the other support member;

(b) positioning the portable frame apparatus on the floor behind the chair, wherein the chair has a rear side, a left side, and a right side, and when positioning the portable frame apparatus adjacent to said chair, said portable frame apparatus is in the unfolded state, the connecting member is located adjacent to the rear side, one of the two support members is located adjacent to the left side, and the other support member is located adjacent to the right side; and (c) applying force to each support member while sitting in the chair, getting into the chair, or getting up from the chair.

2. The method of claim 1 further comprising two cover members, wherein each support member is coupled to one of the cover members.

3. The method of claim 2, wherein the cover members define a height of the portable frame relative to the floor and the height is approximately 25 to 30 inches.

4. The method of claim 2, wherein the portable frame defines a height from the top of the cover members to the floor and a length from the connecting member to the front portions, wherein the ratio of said height to said length is (27.4±0.25)/20.2.

5. The method of claim 1 further comprising a locking mechanism, wherein the locking mechanism is capable of locking the support members in the folded state.

6. The method of claim 1, wherein the chair is armless.

7. The method of claim 6, wherein the chair has a height and said height is higher than the portable frame relative to the floor.

8. The method of claim 6 further comprising a locking mechanism, wherein the locking mechanism is capable of locking the support members in the folded state.

9. The method of claim 1, wherein the chair has a height that is higher than the portable frame.

10. The method of claim 1, wherein the support members are made of aluminum.

11. The method of claim 10, wherein the connecting member is made of aluminum.

12. The method of claim 1, wherein the chair has two arms.

13. The method of claim 12, wherein the two arms of the chair are lower than each of the top portions of the two support members.

14. The method of claim 12, wherein the two arms of the chair are shorter than each of the top portions of the two support members.

15. The method of claim 12, wherein the chair has a height that is higher than the portable frame, wherein the height is relative to the floor.

16. The method of claim 1, wherein the two support members are a first support member and a second support member, wherein:

(a) the first support member is connected to the connecting member at a first end of the top portion of the first support member and the first support member has a second end of the top portion, wherein the second end of the top portion of the first support member is distal to the first end of the top portion of the first support member and the leg of the first support member extends from the second end of the top portion of the first support member; and (b) the second support member is connected to the connecting member at a first end of the top portion of the second support member and the second support member has a second end of the top portion, wherein the second end of the top portion of the second support member is distal to the first end of the top portion of the second support member and the leg of the second support member extends from the second end of the top portion of the second support member.

17. The method of claim 16, wherein the chair comprises a back and the connecting member is positioned adjacent to the back.

18. The method of claim 17, wherein within each support member, the leg is perpendicular to the top portion.

19. The method of claim 1, wherein the connecting member comprises a bar in the form of an inverted U.

* * * * *